United States Patent [19]

Hikake et al.

[11] Patent Number: 5,066,558

[45] Date of Patent: Nov. 19, 1991

[54] DEVELOPER FOR DEVELOPING ELECTROSTATIC IMAGES

[75] Inventors: Norio Hikake; Naoto Kitamori, both of Yokohama, Japan

[73] Assignee: Canon Kabushiki Kaisha, Tokyo, Japan

[21] Appl. No.: 414,297

[22] Filed: Sep. 29, 1989

[30] Foreign Application Priority Data

Sep. 30, 1988 [JP] Japan ..... 63-246303

[51] Int. Cl.[5] ..... G03G 9/08

[52] U.S. Cl. ..... 430/109; 430/110; 430/114

[58] Field of Search ..... 430/109, 110, 114

[56] References Cited

U.S. PATENT DOCUMENTS

| | | | |
|---|---|---|---|
| 2,297,691 | 1/1978 | Carlson | 430/97 |
| 4,623,605 | 11/1986 | Kato et al. | 430/110 |
| 4,737,432 | 4/1988 | Tanaka et al. | 430/110 |
| 4,839,255 | 6/1989 | Hyosu et al. | 430/137 |
| 4,900,647 | 2/1990 | Hikake et al. | 430/137 |
| 4,933,251 | 6/1990 | Ichimura et al. | 430/109 |

FOREIGN PATENT DOCUMENTS

| | | |
|---|---|---|
| 41-020153 | 11/1966 | Japan . |
| 42-023910 | 11/1967 | Japan . |
| 43-024748 | 10/1968 | Japan . |
| 43-027596 | 11/1968 | Japan . |
| 44-006397 | 3/1969 | Japan . |
| 44-018995 | 8/1969 | Japan . |
| 45-026478 | 9/1970 | Japan . |
| 51-081623 | 7/1976 | Japan . |
| 53-081127 | 7/1978 | Japan . |
| 54-002741 | 1/1979 | Japan . |
| 54-016219 | 6/1979 | Japan . |
| 55-120041 | 9/1980 | Japan . |
| 55-042752 | 11/1980 | Japan . |
| 56-001946 | 1/1981 | Japan . |
| 57-93352 | 6/1982 | Japan . |
| 57-125943 | 8/1982 | Japan . |
| 58-060754 | 4/1983 | Japan . |
| 58-041508 | 9/1983 | Japan . |
| 58-186751 | 10/1983 | Japan . |
| 59-007385 | 2/1984 | Japan . |
| 59-200252 | 11/1984 | Japan . |

*Primary Examiner*—John Goodrow

*Attorney, Agent, or Firm*—Fitzpatrick, Cella, Harper & Scinto

[57] ABSTRACT

A developer for developing electrostatic images, comprising: 100 wt. parts of a toner comprising toner particles, and 0.01–3 wt. parts of silica powder which has a particle size of 0.006–0.2 micron and is not fixed to the surfaces of the toner particles; the toner particles comprising 100 wt. parts of colored resinous particles (A) and 0.05–5 wt. parts of silica powder comprising silica particles which have a particle size of 0.002–0.2 micron and have been embedded in the surfaces of the colored resinous particles by mechanical impact means.

15 Claims, 7 Drawing Sheets

DEVELOPER FOR DEVELOPING ELECTROSTATIC IMAGES

FIELD OF THE INVENTION AND RELATED ART

The present invention relates to a developer containing a toner for developing electrostatic images formed in an image forming method such as electrophotography, electrostatic recording and electrostatic printing.

Hitherto, a large number of electrophotographic processes have been known, as disclosed in U.S. Pat. No. 2,297,691 and Japanese Patent Publication (JP-B, Kokoku) Nos. 23910/1967 and 24748/1968. Generally speaking, photoconductive materials are utilized in these processes and the steps included therein comprise forming electrical latent images on photosensitive members by various means, then developing the latent images by using a toner, transferring the toner images thus formed to a transfer material such as paper, as desired, and thereafter fixing the images by heating, pressure, heat and pressure or solvent vapor to obtain copies.

The method of charging particles used for development (i.e., toner particles) or a developer may for example include: (1) the charge injection method wherein charges are injected into electroconductive toner particles; (2) the dielectric polarization method utilizing the dielectric polarization of a toner under an electric field; (3) the ion current charging method wherein particles such as toner particles are provided with a shower of charged ions, e.g., by means of a corona charger; and (4) the triboelectrification method wherein toner particles are charged by rubbing them with an object which has a different position from the toner particles in the triboelectric series.

Among these, in the charge injection method, since the toner used is electroconductive, it is difficult to electrostatically transfer the toner from the latent image-bearing surface to a medium such as paper to which the toner is to be fixed.

In the dielectric polarization method, the developing speed is low and a sufficiently large amount of charges are difficult to be generated. In the ion current charging method, it is technically difficult to uniformly expose the toner particles to the ion current, and it is difficult to reproducibly regulate the charge amount.

On the other hand, since the triboelectrification method uses an insulating toner, and is capable of reproducibly regulating the charge amount to a sufficiently high level, it has widely been used at present. In practical development, however, since the triboelectric charge amount is proportional to the friction work, it is difficult to always retain the friction work of the toner particles at a constant value. As a result, an excess or insufficiency of charge amount is liable to occur, and the charge amount tends to be affected by environmental conditions, especially humidity.

Further, there is a tendency such that the resinous or waxy component of a toner permanently adheres to the surfaces of respective portions of carrier particles or a developing device with which the toner particles are rubbed, whereby the amount of such a component is gradually increased. Such a phenomenon can change the triboelectric charging characteristic of the toner with respect to the above-mentioned members with which the toner particles are rubbed, and therefore deterioration in the quality of copied images tends to occur when a large number of copies are intended to be obtained.

In order to solve such a problem, there has been proposed a method wherein silica powder in the form of fine particles is added to a developer by itself or together with another functional material, as described in, e.g., Japanese Patent Publication (JP-B, KOKOKU) No. 16219/1979, Japanese Laid-Open Patent Application (JP-A, KOKAI) Nos. 120041/1980 and 81127/1978. Further, Japanese Laid-Open Patent Application Nos. 60754/1983, 186751/1983 and 200252/1984 propose the use of silica for the purpose of controlling the hydrophobicity and chargeability of a toner.

In general, the above-mentioned silica is added to the developer by simple addition or by using a mixer which uses a stirring vane rotating at a peripheral speed of about several meters to 40 meters per second (m/sec). In such a case, a portion of the silica powder added is electrostatically attached to the surfaces of the toner particles and another portion is present in a freed or liberated state, whereby the silica powder contributes to the improvement in fluidity or flowability of the toner particles. However, when the thus obtained toner supplied with the silica is used to obtain a large number of copies, in some cases, the silica content in the toner can be decreased, the toner fluidity or the resultant image density can be decreased, or fog in the resultant image can be increased due to a decrease in the cleaning characteristic of the toner. Further, when the toner or developer is left standing for a long period and thereafter used for development, the fluidity of the toner or developer is deteriorated, and the toner or developer can provide an increase in fog or a decrease in the image density in some cases. Particularly, such a phenomenon becomes noticeable when the toner is used for development under a high-humidity condition.

There has also been proposed a method wherein silica powder is contained in toner particles or fixed to their surfaces. For example, there is a method wherein silica powder is added to the materials of a toner such as binder resin, colorant and charge controller, the resultant mixture is melt-kneaded and cooled, and then the kneaded product is pulverized and classified thereby to produce a toner. The method of adding silica into toner particles is disclosed in, e.g., Japanese Patent Publication No. 18995/1969, and Japanese Laid-Open Patent Application Nos. 81623/1976 and 1946/1981. In a case where such a method is used, when a sufficient effect is intended by causing silica to be present at and in the vicinity of toner particle surfaces, a large amount of silica must be added to the toner materials at the time of the melt-kneading. Such addition of silica poses a serious problem in the production of a toner, and further causes a decrease in fixability thereof. Such a phenomenon is particularly noticeable in the case of a heat-fixable toner. Further, when the above-mentioned method is used, there is a low probability that the silica is present at the toner particle surfaces. As a result, such a method is not sufficient to solve the above-mentioned problems while it somewhat produces an improvement.

In order to fix silica to the surfaces of toner particles, there has been proposed a method wherein silica powder is added to a toner and mixed therewith, and thereafter the resultant mixture is heated to a temperature which is not lower than the softening temperature of the toner (Japanese Laid-Open Patent Application Nos. 2741/1979 and 125943/1982). In this method, however, since the toner particles are liable to agglomerate due to heat thereby to produce coarse particles, a step of removing such coarse particles is required, whereby the yield in the production process is lowered. Further, the heat treatment causes a decrease in the developing characteristics of the toner (e.g., a decrease in image density) and the production cost is raised.

SUMMARY OF THE INVENTION

An object of the present invention is to provide a developer for developing electrostatic images which has solved the above-mentioned problems.

Another object of the present invention is to provide a developer for developing electrostatic images which has good fluidity, is capable of providing a high image density without causing fog, and is little deteriorated so as to provide good images even when subjected to successive copying to provide a large number of copies.

A further object of the present invention is to provide a developer for developing electrostatic images which is little deteriorated so as to provide good images with little fog, even after it is left standing for a long period.

According to the present invention, there is provided a developer for developing electrostatic images, comprising: 100 wt. parts of a toner comprising toner particles, and 0.01–3 wt. parts of silica powder which has a particle size of 0.005–0.2 micron and is not fixed to the surfaces of the toner particles; the toner particles comprising 100 wt. parts of colored resinous particles (A) and 0.05–5 wt. parts of silica powder comprising silica particles which have a particle size of 0.002–0.2 micron and have been embedded in the surfaces of the colored resinous particles by mechanical impact means.

According to our investigation, the reason for an increase in fog or a decrease in image density encountered in the prior art may be considered that the silica powder electrostatically attached to the toner particles is freed therefrom due to charge leak in the toner particles and/or silica powder in long-term storage. Accordingly, in a case where the amount of silica to be added to toner particles is small in the prior art, it is considered that when the toner is used for providing a large number of copies, the effect of decrease in the silica content appears early and the resultant image quality is rapidly deteriorated. On the other hand, in a case where the amount of silica to be added is too large in the prior art, it is considered that such addition is liable to cause an image density decrease and fog in the resultant image.

These and other objects, features and advantages of the present invention will become more apparent upon a consideration of the following description of the preferred embodiments of the present invention taken in conjunction with the accompanying drawings.

DETAILED DESCRIPTION OF THE INVENTION

The developer according to the present invention may for example be prepared by producing colored resinous base particles (A) comprising a binder resin and a colorant; fixing silica powder (B) to the base particles (A) by using mechanical impact thereby to prepare a toner for developing electrostatic images; and adding silica powder (C) to the toner and mixing the silica powder (C) with the toner.

Hereinbelow, the present invention will be described in detail.

The toner according to the present invention comprises: base particles (A) having a desired particle size, and silica powder (B) which has been firmly fixed to or embedded the surfaces of the base particles (A) by mechanical impact. The developer according to the present invention comprises the above-mentioned toner particles and silica powder (C) not being fixed to the toner particles. The base particles (A) may preferably comprises at least a binder resin and a colorant.

Hereinbelow, there will be described a preferred embodiment of the process for producing the toner or developer according to the present invention.

In such an embodiment, the fixing process comprises a pretreatment step wherein silica powder (B) is dispersed in the base particles (A) to uniformly attach the silica powder to the base particles, and a fixing step wherein the attached silica powder (B) is fixed to the base particles (A) under the action of an impact force.

The pretreatment step can be omitted in some cases, but it is preferred to conduct the pretreatment step in order to effect uniform fixing.

In the pretreatment step, the silica powder (B), while dispersed in the base particles (A), are rubbed with the base particles (A), whereby the silica powder (B) is attached to the surfaces of the base particles under the action of an electrostatic force (and a Van der Walls force). In this step, a mixer having a stirring vane rotatable at a high speed may generally be used, but a mixer used in this step is not restricted thereto. More specifically, another mixer may be used as far as it has a mixing function and a dispersing function.

Figure 1:
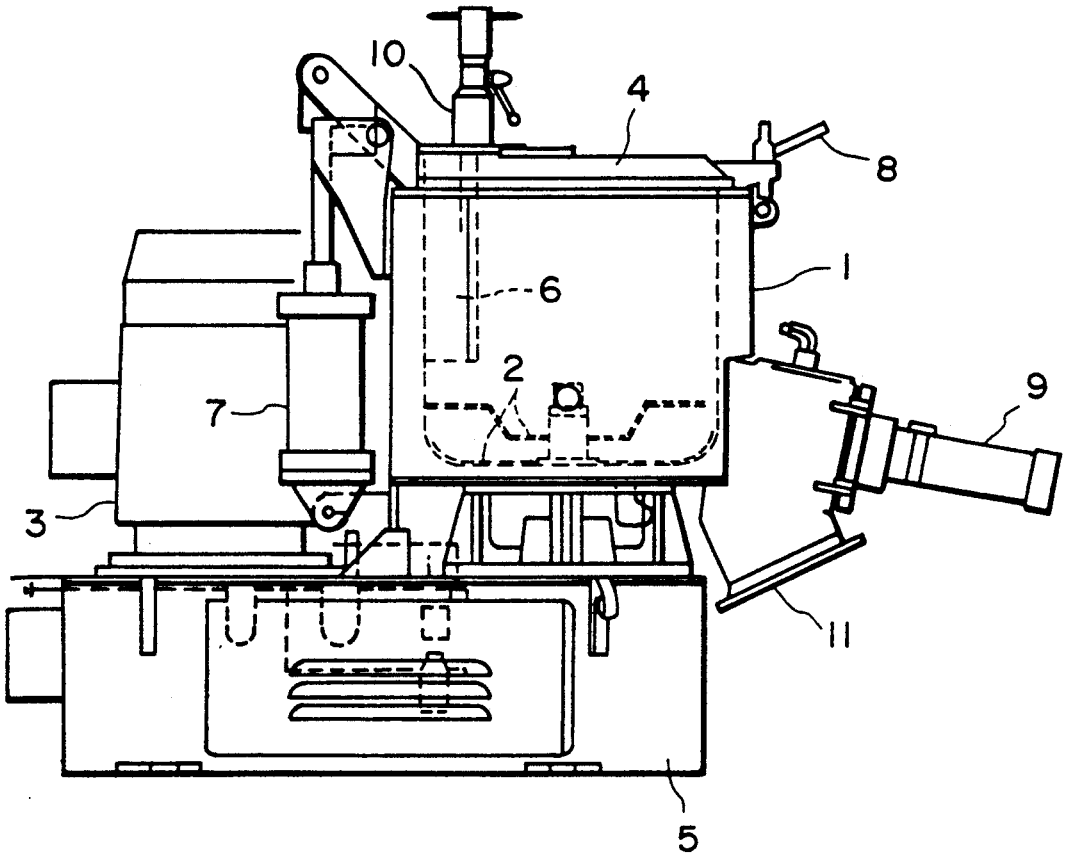
FIG. 1 is a schematic sectional view showing an embodiment of a stirring device for pretreating base particles (A) and silica powder (B)

FIG. 1 shows an embodiment of a mixer (Henchel mixer) having a high-speed stirring vane, which is usable in the pretreatment. The mixer shown in FIG. 1 comprises a jacket 1, a stirring vane 2, a motor 3 for driving the stirring vane, a lid 4, a base 5, a control plate 6 for collision with powder, a cylinder 7 for lifting the lid, a locking device for the lid, a cylinder 9, a direction control unit 10 for changing the angle of the control plate, and a discharge port 11.

In the pretreatment, it is preferred that both the base particles (A) and the silica powder (B) are sufficiently dispersed, and that the base particles (A) are not substantially pulverized, and the silica powder is not partially fixed to the base particles (A). In the pretreatment, in consideration of the physical properties of a material for toner, the following conditions may preferably be used: a treatment temperature (ambient temperature) of 0°-50° C., more preferably 10°-40° C., which is preferably lower than the softening point of the base particles (A); a peripheral speed at the tip of a stirring vane of 5-50 m/sec; a treatment time of 10 sec-24 hours, more preferably 1-60 min, particularly preferably 1-20 min; the length of a stirring vane of 10-100 cm, which is preferable in view of mixing efficiency and the prevention of the pulverization. Further, in this treatment, the treatment chamber may preferably be cooled by means of a jacket or cooling air.

As the device for the pretreatment, in addition to the above-mentioned mixer having a high-speed stirring vane, there may be used a device which has dispersing and mixing functions and can provide a sufficiently long residence time. More specifically, there may be used a machine such as pulverizer, a vibration mill, and ball mill, while reducing the impact force thereof so as to satisfy the above-mentioned conditions.

Then, a method of fixing will be described.

It is not preferred that the fragment of the base particles (A) are freed, or that the silica powder (B) once attached to the base particles (A) is again freed therefrom. Further, in this step, it is important to modify a machine having a structure similar to a pulverizer so as to extend the residence time therein, to control the impact force so that the toner particles are not substantially pulverized, and to control the temperature so that fusion of the toner particles does not occur.

Figure 2A:
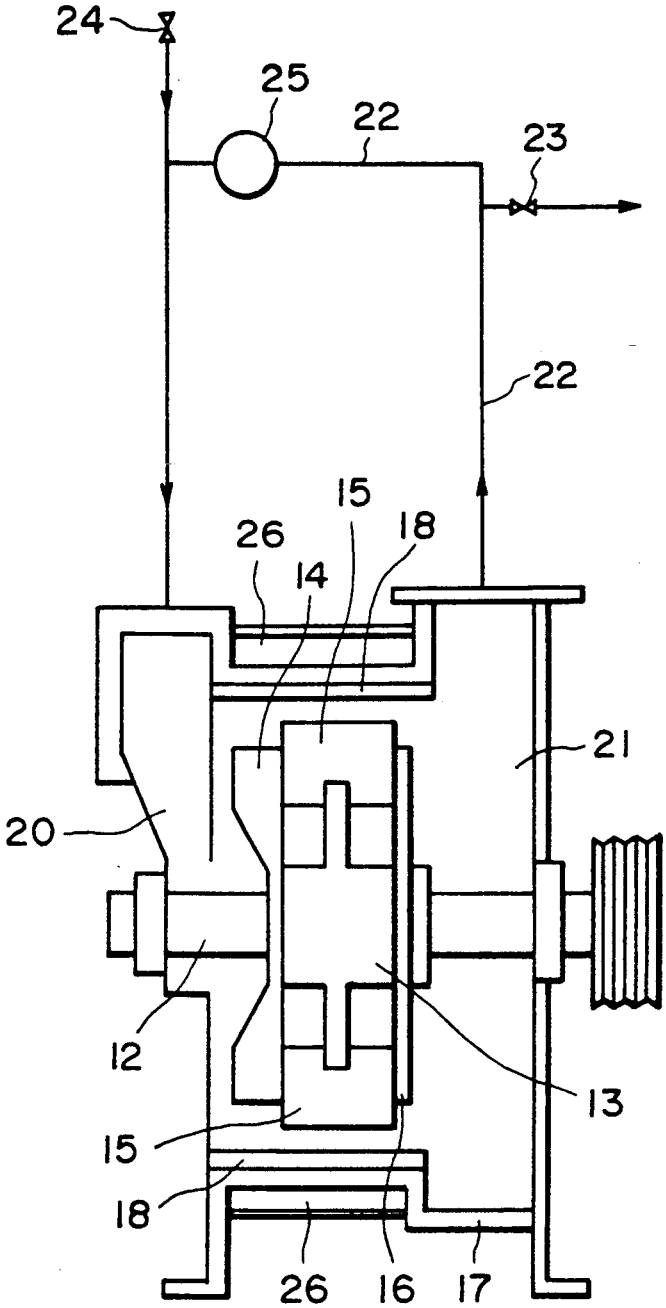
FIG. 2A is a schematic sectional view showing an embodiment of a device for fixing the silica powder (B) to the base particles (A)
Figure 3A:
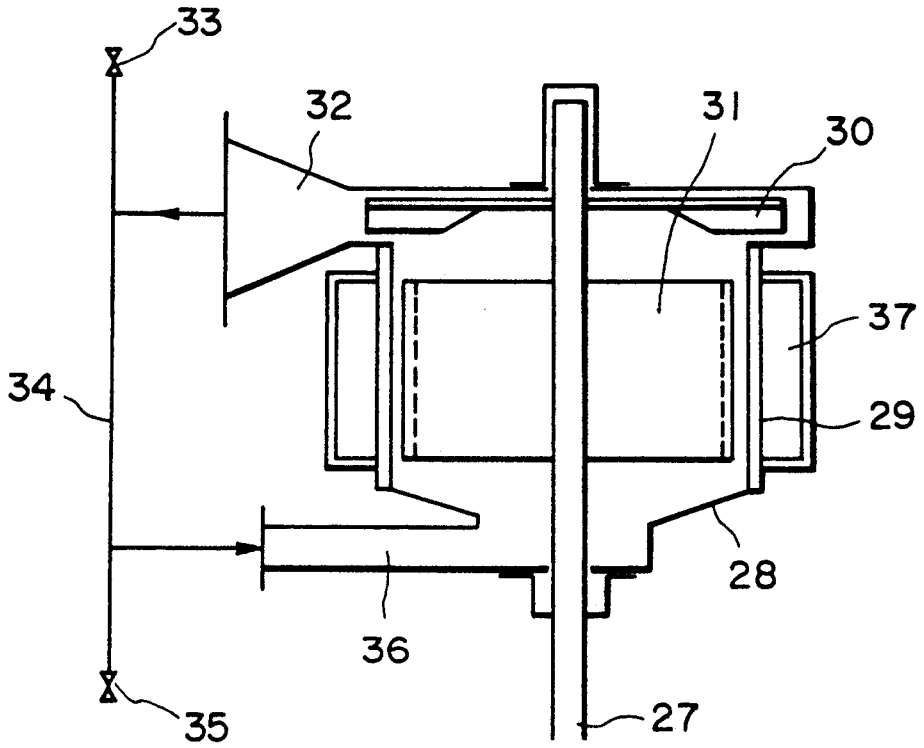
FIG. 3A is a schematic sectional view showing another embodiment of a device for fixing the silica powder (B) to the base particles (A)
Figure 3B:
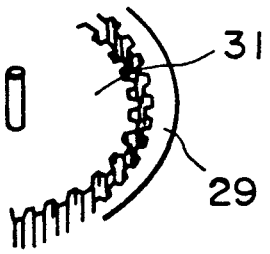
FIGS. 3B and 3C are enlarged schematic views each showing a part of the device shown in FIG. 3A.
Figure 4A:
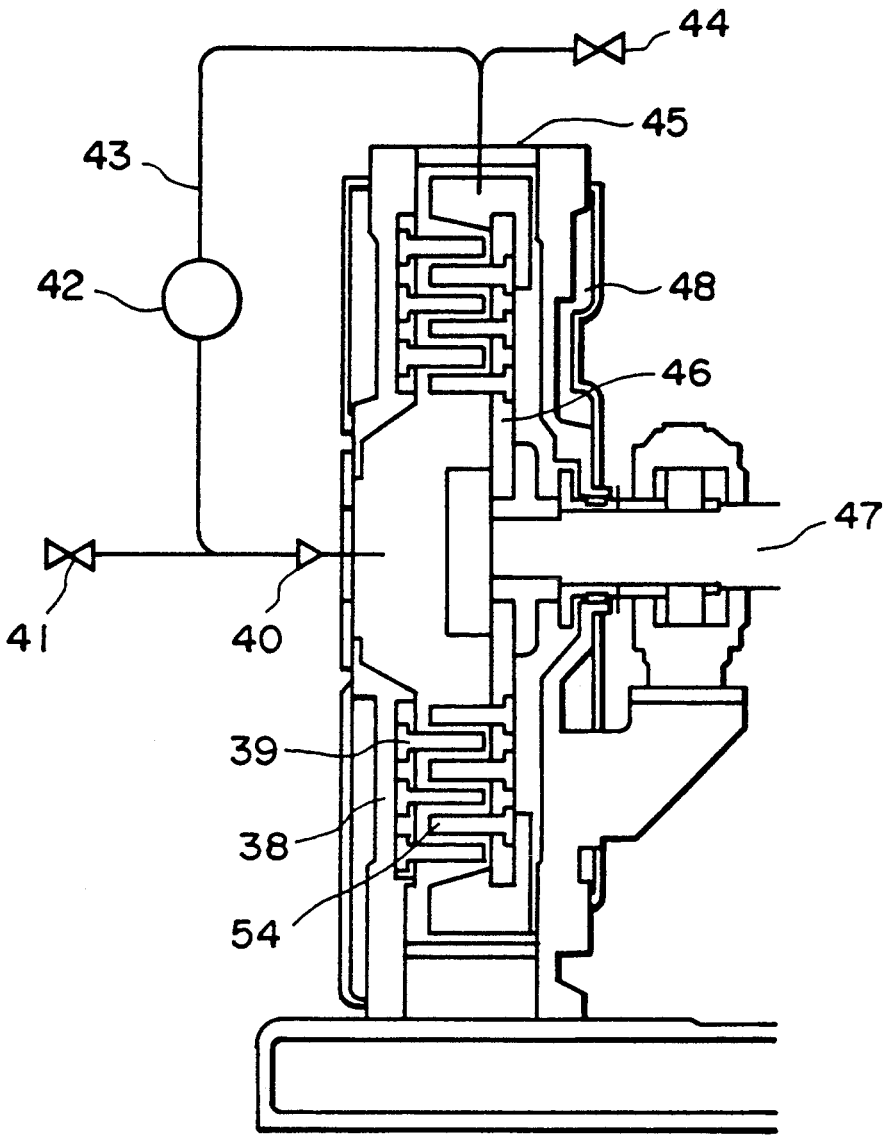
FIG. 4A is a schematic sectional view showing an embodiment of a pin mill-type device for fixing the powder particle (B) to the base particles (A)

For example, there may effectively be used: a pin mill as shown in FIG. 4A which has a recycling function and has a large number of rotating pins; or a pulverizer as shown in FIG. 2A or 3A which has a recycling mechanism and wherein an impact force is provided between a liner (fixed member) and a rotating blade or hammer (rotating member).

The device shown in FIG. 2A for fixing silica powder (B) to the surfaces of base particles (A) comprises a rotation axis 12, a rotor 13, a dispersing vane 14, a rotating member (blade) 15, a partition circular plate 16, a casing 17, a liner (fixed member) 18, an impact zone 19 (FIG. 2B), an inlet chamber 20, an outlet chamber 21, a return conduit 22, an outlet valve 23 for a product, an intake valve 24 for a feed material, a blower 25, and a jacket 26.

The device as shown in FIG. 3A for fixing silica powder (B) to the surfaces of base particles (A) comprises a rotation axis 27, a casing 28, a liner 29, a blower vane 30, a rotor 31 having a blade, an outlet port 32, a feed material supply port 33, a return conduit 34, an outlet 35 for a product, an inlet port 36, and a jacket 37.

Figure 4B:
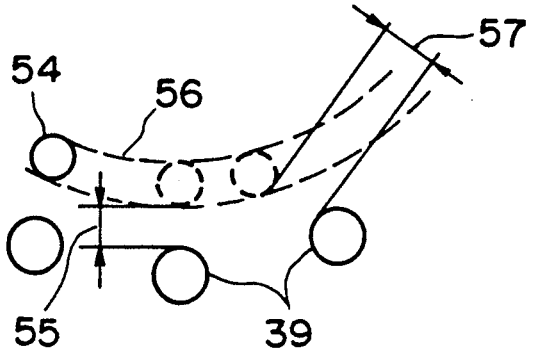
FIG. 4B is an enlarged schematic sectional view showing a part of the device shown in FIG. 4A.

The device as shown in FIG. 4A for fixing silica powder (B) to the surfaces of base particles (A) comprises a casing 38, a fixed pin 39, an inlet port 40, a feed material supply port 41, a recycling blower 42, a return conduit 43, an outlet 44 for a product, an outlet port 45, a rotor 46, a rotation axis 47, a jacket 48, and a rotating pin 54. In FIG. 4B, reference numeral 55 denotes a minimum clearance between the rotating pin 54 and the fixed pin 39, numeral 57 denotes a maximum clearance therebetween, and numeral 56 denotes the locus of the rotating pin 54.

The fixing step may preferably be conducted at a peripheral speed of 30-130 m/sec, more preferably 30-100 m/sec, at the tip of the blade or hammer. The temperature in the fixing step may preferably be 2°-100° C., more preferably 30°-90° C., while it varies depending on the physical property of the base particles (A). Further, the residence time or cycling time for the treatment may preferably be about several seconds to one hour, more preferably 10 sec to 30 min.

In the type of a machine as shown in FIG. 2A or 3A, more latitude in the treating conditions may be allowed because the base particles (A) and silica powder to be treated are gathered into the vicinity of the liner under the action of a centrifugal force.

Figure 2B:
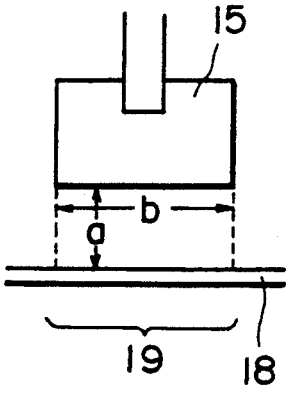
FIG. 2B is an enlarged schematic sectional view showing a part of the device shown in FIG. 2A.

In FIG. 2B, the clearance a between the rotating member (blade) 15 and the liner 18 is a minimum clearance, and the space corresponding to the width b of the rotating blade 15 is an impact zone. The width b may preferably be 10-1000 mm. Further, the distance from the tip of a blade 15 on one side to that of the blade 15 on the opposite side (i.e., the distance from the tip of the upper blade 15 to that of the lower blade 15, as shown in FIG. 2A) may preferably be 100-1000 mm in view of fixing efficiency.

Figure 3C:
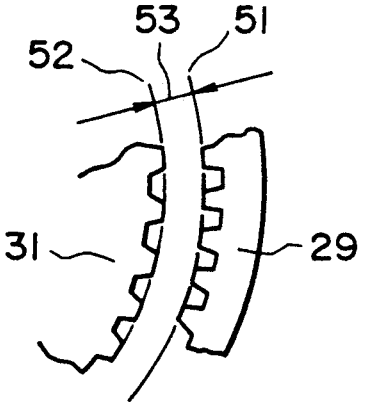

FIG. 3C shows a positional relationship between the liner 29 and the rotating rotor 31 in the fixing device shown in FIG. 3A. The minimum clearance 53 between the liner 29 and the rotor 31 is the difference in radius between two kinds of circles, i.e., a circle 51 obtained by connecting the tip points of the projections or protrusions of the liner 29 protruding toward the inside of the device; and a circle 52 traced by the point on the periphery of the projection or protrusion of the rotor 31. This minimum clearance 53 may be determined in the same manner as described above, in a case where a blade or a hammer is used instead of the rotor 31. The shape of the liner 29 is not restricted to that shown in FIG. 3C, but the liner may also have a corrugated shape, a sawing blade-like shape, or a flat shape, in connection with the peripheral speed of the rotor 31.

The minimum clearance between the liner and the blade or hammer may preferably be about 0.5-10 mm, more preferably 1-7 mm in order to obtain more desirable results of fixing.

More specifically, referring to FIG. 2A, the base particles (A) and the silica powder (B) pretreated in the above-mentioned manner are supplied through the inlet 24, passed through the inlet chamber 20, and then passed through the impact zone 19 between the liner 18 and the blade 15 which rotates along the rotating dispersing vane 14. Thereafter, these particles are passed through the outlet chamber 21, the return conduit 22 and the blower 25, and again recycled in such a circuit. After the completion of the fixing treatment, the treated base particles (A) are discharged through the outlet 23 for a product.

In this treatment, the powder comprising the base particles (A) and the silica powder (B) are supplied with an impact force in the impact zone 19 surrounded by the blade 15 and the liner 18, whereby the silica powder (B) is fixed to the surfaces of the base particles (A). It is preferred to control the surrounding temperature by supplying cooling water to the jacket 26.

The above-mentioned fixing method is superior in the following viewpoints to the method wherein fixing is effected by simply heating particles or by exposing particles to a solvent vapor.

(1) In the method of simply heating particles, it is difficult to prevent the agglomeration of particles (A) due to the fusion thereof. Further, there is a certain limit to the material usable in such a method.

(2) In the method of using a solvent vapor, it is difficult to prevent the agglomeration of particles (A) due to the adsorption of the solvent, and there is a certain limit to the material usable in such a method. Further, it is difficult to completely remove the adsorbed solvent, and high-temperature heating or pressure-reducing operation is required for the complete removal, whereby the production cost is raised. Further, when the solvent remains in the resultant toner, such a toner is not preferred because it considerably agglomerates in the storage thereof or shows a considerable change with the elapse of time.

The base particles (A) may for example be prepared in the following manner. When a pulverization method is used, a mixture comprising at least a binder resin and a colorant (optionally, further comprising a releasing agent, and/or a charge-controlling agent) is melt-kneaded, and cooled, the resultant mixture is pulverized by means of a known pulverizer, and optionally the pulverized product is subjected to classification so as to adjust the particle size distribution thereof, whereby base particles (A) are prepared. The base particles (A) for providing a toner for development may preferably have a volume-average particle size of 2–20 microns.

In the present invention, the particle size distribution and average particle size may be measured by the following method.

Coulter Counter Model TA-II (mfd. by Coulter Electronics Inc.) or Elzone Particle Counter Model 80 XY-2 (mfd. by Particle Data Inc., U.S.A.) is used as a measuring device and a number-average (or number-basis) particle size distribution and a volume-average (or volume-basis) particle size distribution are output. A 1–4% aqueous NaCl solution is used as an electrolytic solution.

In the measurement, 0.1–5 ml of a surfactant, as a dispersing agent (preferably of alkylbenzenesulfonate) is added to 100–150 ml of the above-mentioned aqueous electrolytic solution, and further 0.5–50 mg of a sample for measurement is added to the resultant mixture and suspended. The resultant suspension of the sample in the electrolytic solution is dispersed by means of an ultrasonic dispersing device for about 1––3 min. Thereafter, the particle size distribution of particles having a particle size of 0.2–40 microns is measured by means of the above-mentioned Coulter Counter TA-II or Elzone Particle Counter 80 XY-2 with an aperture of 12–120 microns, whereby the number-average particle size distribution and the volume-average particle size distribution are determined.

The resin to be used in the present invention may be a binder resin for toner. Examples thereof include: homopolymers of styrene and substituted derivatives thereof such as polystyrene; styrene copolymer such as styrene-acrylic acid ester copolymer, styrene-methacrylic acid ester copolymer, styrene-acrylonitrile copolymer, styrene-butadiene copolymer, styrene-isoprene copolymer, and styrene-acrylonitrile-indene copolymer; acrylic resins, methacrylic resins, silicone resins, polyester resins, furan resins, and epoxy resins.

In the present invention, there may preferably be used a crosslinked styrene copolymer or a crosslinked polyester. Examples of comonomers to be copolymerized in the above-mentioned styrene copolymer include: monocarboxylic acids having a double bond or substituted derivatives thereof such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond or substituted derivatives thereof such as maleic acid, butyl maleate, methyl maleate, and dimethyl maleate.

Further, there may mainly be used a compound having two or more polymerizable double bonds, as the crosslinking agent. Examples of such a crosslinking agent may include: aromatic divinyl compounds such as divinylbenzene and divinylnaphthalene; carboxylic acid esters having two double bonds such as ethylene glycol diacrylate, ethylene glycol dimethacrylate, and 1,3-butanediol dimethacrylate; divinyl compounds such as divinylaniline, divinyl ether, divinyl sulfide and divinyl sulfone; and compounds having three or more vinyl groups. These compounds may be used singly or as a mixture. The crosslinking agent may preferably be used in an amount of 0.1–5 wt. % base on the weight of the monomer.

Next, the colorant usable in the present invention is described.

In order to produce a magnetic toner, magnetic particles are added into the base particles (A). In this case, the magnetic particles also function as a colorant. The magnetic particles usable in the present invention may be a substance magnetizable when placed in a magnetic field, such as powder of a ferromagnetic metal such as iron, cobalt and nickel, or an ally or compound thereof such as magnetite, hematite and ferrite. The magnetic particles may preferably have a particle size 0.1–1 micron, more preferably 0.1–0.5 micron. The content of the magnetic particles may suitably be 10–65 wt. %, preferably 20–60 wt. %, based on the weight of the toner. It is possible that the magnetic particles have been treated with a treating agent such as silane coupling agent or titanate coupling agent or with an appropriate reactive resin. In this case, while also depending on the surface area of the magnetic particles or the density of the hydroxyl group present at the surface thereof, a treating amount of 5 wt. % or less, preferably 0.1–3 wt. %, may provide a sufficient dispersibility.

The colorant may also comprise known dyes or pigments such as carbon black or grafted carbon black obtained by coating the surface of carbon black with a resin. The colorant may be contained in a proportion of 0.5–30 wt. % based on the weight of the binder resin.

As the charge controller usable in the toner of the present invention, positive or negative charge controllers which are solid at least in a temperature range of 20°–90° C. can be used. Examples of charge controllers used in the present invention may include those as described below.

(1) As the controller which controls the toner to be positively chargeable, the following substances may be included:

nigrosin, azine dyes having an alkyl group containing 2–16 carbon atoms (as disclosed in Japanese Patent Publication (JP-B, Kokoku) No. 1627/1967), basic dyes including, e.g., C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000); lake pigments of these basic dyes (lake-forming agent may be phosphotungstic acid, phosphomolybdic acid, phosphotungstomolybdic acid, tannic acid, lauric acid, gallic acid, ferricyanide, ferrocyanide); C.I. Solvent Black 3 (C.I. 26150), Hansa Yellow G (C.I. 11680), C.I. Mordant Black 11, C.I. Pigment Black 1, benzylmethyl-hexadecylammonium chloride and decyl-trimethylammonium chloride; dialkyltin or dialkyltin borate compounds having groups such as dibutyl and dioctyl; guanidine derivative; vinyl polymers having an amino group; polyamine resins such as condensation-polymerized polymer having an amino group.

(2) As the controller which controls a toner to be negatively chargeable, the following substances may be included:

metal complex compounds of monoazo dyes as disclosed in Japanese Patent Publication (Kokoku) Nos. 20153/1966, 27596/1968, 6397/1969, 26478/1970;

metal complex compounds containing a Zn, Al, Co, Cr or Fe atom and salicylic acid, dialkyl-salicylic acid, naphthoic acid or dicarboxylic acids as disclosed in Japanese Patent Publication (Kokoku) Nos. 42752/1980, 41508/1983, 7384/1983 and 7385/1984; and sulfonated copper phthalocyanine pigments.

Further, it is preferred that the charge controller used in the present invention has characteristics of little environmental dependence, thermal stability, mechanical stability and chemical stability.

The base particles (A) can contain a release agent having a releasing property.

Examples of the release agent may include those as described below. The release agent may preferably be a low-softening point substance having a softening point measured by the ring and ball method (as described in JIS K 2531) of 40°-130° C., more preferably 50°-120° C. If the softening point is below 40° C., the anti-blocking property and the shape-retaining property of the toner may be insufficient. On the other hand, if the softening point is above 130° C., the effect in reducing a fixing temperature or a fixing pressure is a little. The low-softening point substance may preferably be used in an amount of 0.1-8 wt. %, more preferably 1-5 wt. % based on the resin component.

Examples of such low-softening point compound include paraffin waxes, low-molecular weight polyolefins, modified waxes having an aromatic group, hydrocarbon compounds having an alicyclic group, natural waxes, long-chain carboxylic acids having a long hydrocarbon chain ($CH_3(CH_2)_{11}$ or $(CH_2)_{12}$ or a longer aliphatic chain) including 12 or more carbon atoms, esters and metal salts thereof, fatty acid amides and fatty acid bisamides. A mixture of different low-softening point compounds may be mixed. The low-softening point compound may preferably be contained in an amount of 1-100 wt. parts, per 100 wt. parts of the binder resin.

More specifically, examples of commercially available products include Paraffin Wax (Nihon Sekiyu K.K.), Paraffin Wax (Nihon Seiro K.K.), Microwax (Nihon Sekiyu K.K.), Microcrystalline Wax (Nihon Seiro K.K.), PE-130 (Hoechst), Mitsui Hi-Wax 110P (Mitsui Sekiyu Kagaku K.K.), Mitsui Hi-Wax 220P (ditto), Mitsui Hi-Wax 660P (ditto), Mitsui Hi-Wax 210P (ditto), Mitsui Hi-Wax 320P (ditto), Mitsui Hi-Wax 410P (ditto), Mitsui Hi-Wax 420P (ditto), Modified Wax JC-1141 (ditto), Modified Wax JC-2130 (ditto), Modified Wax JC-4020 (ditto), Modified Wax JC-1142 (ditto), Modified Wax JC-5020 (ditto); bees wax, carnauba wax, and montan wax.

On the other hand, examples of the fatty acid metal salt may include: zinc stearate, calcium stearate, magnesium stearate, zinc oleate, zinc palmitate, and magnesium palmitate.

The base particles (A) may be obtained by pulverizing a binder resin alone and classifying the pulverized product; or by melt-kneading a binder resin and another material such as the above-mentioned colorant, release agent and magnetic material, pulverizing the kneaded product and classifying the pulverized product.

The base particles (A) may also be prepared by using a polymerization method in the following manner.

A polymerizable monomer composition comprising at least a polymerizable monomer, a colorant and a polymerization initiator (optionally, further comprising an additive such as a crosslinking agent, a charge controller, or a polar polymer, as described below) is charged into an aqueous phase containing a suspension stabilizer, the polymerizable monomer composition is dispersed and is formed into particles under stirring and is subjected to polymerization.

Then, the suspension stabilizer is removed from the reaction product, as desired, and the resultant reaction product is subjected to filtration and drying thereby to prepare base particles (A).

It is particularly preferred to obtain the base particles (A) through a suspension polymerization method as described below, because the resultant base particles (A) may have a sharp particle size distribution.

In a case where the base particles (A) comprise colored particles prepared through polymerization (hereinafter, sometimes referred to as "colored polymer particles"), the polymerizable monomer applicable to the present invention may be those having a vinyl group ($CH_2=C<$). Examples thereof may include: styrene, styrene derivatives such as o-methylstyrene, m-methylstyrene, p-methylstyrene, p-methoxystyrene, and p-ethylstyrene; acrylic acid, methacrylic acid, maleic acid and maleic acid half esters; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; and monomers having a reactive double bond such as derivatives of cyclic acid or methacrylic acid including acrylonitrile, methacrylonitrile, and acrylamide. These monomers may be used either singly or in mixture of two or more species.

In the present invention, a crosslinking agent may be used, as desired. Examples of the crosslinking agent may include: divinylbenzene, divinylnaphthalene, diethylene glycol dimethacrylate, and ethylene glycol dimethacrylate. The amount of use of the crosslinking agent may suitably be 0.1-5 wt. parts, per 100 wt. parts of the polymerizable monomer.

Further, a polymer of the above-mentioned polymerizable monomer may be added to a polymerizable monomer composition in a relatively small amount. In the present invention, it is preferred to use base particles (A) produced from styrene, a styrene derivative having a substituent such as alkyl group, or a monomer mixture of styrene and another monomer, in view of the developing characteristics and durability of the resultant colored particles (A) produced from polymerization.

If a polar polymer (inclusive of copolymer) or cyclized rubber is added to a polymerizable monomer to be polymerized, preferable base particles (A) having a pseudo-capsule structure can be obtained. The polar polymer or cyclic rubber may preferably be added in an amount of 0.5-50 wt. parts, preferably 1-40 wt. parts, per 100 wt. parts of the polymerizable monomer. Below 0.5 wt. parts, it is difficult to obtain a desired pseudo-capsule structure. Above 50 wt. parts, there arises an increased tendency that the characteristics of the toner are lowered because the amount of the polymerizable monomer becomes insufficient. It is preferred that a polymerizable monomer composition containing the polar polymer or cyclized rubber thus added is suspended in an aqueous medium containing a dispersant disposed therein having a chargeability to a polarity opposite to that of the polar polymer.

The cationic polymer (inclusive of copolymer), anionic polymer (inclusive of copolymer) or anionic cyclized rubber thus contained in the polymerizable monomer composition exerts an electrostatic force at the surface of toner-forming particles with the oppositely chargeable anionic or cationic dispersant dispersed in the aqueous medium, so that the dispersant covers the surface of the particles to prevent coalescence of the particles with each other and to stabilize the dispersion. In addition, as the added polar polymer or cyclized rubber gathers at the surface layer of the particles, a sort of shell is formed to provide the particles with a pseudo-capsule structure. The polar polymer or cyclized rubber or a relatively large molecular weight thus gathered at the particle surfaces may envelope a large amount of the low-softening point compound inside thereof to provide the colored polymer particles (A) with excellent anti-blocking characteristic, developing characteristic and abrasion resistance. Examples of the polar polymer (inclusive or copolymer and cyclized rubber) and the dispersant or dispersion stabilizer having a chargeability usable in the present invention may be raised thereinbelow. The polar polymer having a weight-average molecular weight of 5,000-500,000 as measured by GPC (gel permeation chromatography) is preferred because of good solubility in the polymerizable monomer and characteristic of providing good durability of a toner.

(i) Cationic polymers: polymers of nitrogen-containing monomers such as dimethylaminoethyl methacrylate and diethylaminoethyl acrylate; copolymers of styrene and such a nitrogen-containing monomer; and a ternary copolymer of styrene, an unsaturated carboxylic acid ester and such a nitrogen-containing monomer.

(ii) Anionic polymers: polymers of copolymers of anionic monomers inclusive of nitrile monomers such as acrylonitrile, halogen-containing monomers such as vinyl chloride, unsaturated carboxylic acid such as acrylic acid, unsaturated dibasic acids, and unsaturated dibasic acid anhydrides; and copolymers of styrene and such an anionic monomer. Cyclized rubber may also be used as an anionic polymer.

The dispersant may preferably be hardly water-soluble or substantially water-insoluble inorganic fine powder capable of stabilizing the dispersion of the monomer composition particles in an aqueous medium. The amount of addition of the dispersant may preferably be 0.1-50 wt. %, particularly 1-20 wt. %, based on the water.

(iii) Anionic dispersant: colloidal silica such as Aerosil #200, #300 (mfd. by Nihon Aerosil K.K.).

(iv) Cationic dispersant: aluminum oxide, magnesium hydroxide and hydrophilic positively chargeable silica fine powder such as aminoalkyl-modified colloidal silica obtained through treatment with a coupling agent.

In order to produce colored polymer particles (A) containing a magnetic material, magnetic particles are added into the monomer composition. In this case, the magnetic particles also function as a colorant. The magnetic particles usable in such a case may be a substance selected from those as described hereinabove. The colored polymer particles (A) contain a colorant selected from those as described hereinabove. The colorant may be contained in a proportion of 0.5-30 wt. parts based on the polymer of a polymerizable monomer and the low-softening compound. It is possible to add a charge controller, a fluidity improver, or a release agent, as desired into the toner (internal addition).

In the suspension polymerization, a monomer composition comprising a polymerizable monomer a colorant, and an optional additive in a uniformly dissolved or dispersed state is dispersed in an aqueous medium, e.g., heated to a temperature which is 5° C. or more, preferably 10°-30° C., higher than a subsequent polymerization temperature and containing 0.1-50 wt. of a suspension stabilizer (e.g., hardly water-soluble inorganic dispersant) under stirring by means of an ordinary stirrer or a high-shearing force stirrer such as homomixer and homogenizer. Preferably, the speed and time for stirring and the temperature of the aqueous medium may be adjusted so that the droplets of the melted or softened monomer composition have a desired toner particle size of 30 microns or below (e.g., 0.1-20 microns, more preferably 2-20 microns, in terms of a volume-average particle size). After that, while stirring is effected to such an extent that the dispersion state is substantially maintained as such because of the function of the dispersion stabilizer, while preventing the sedimentation, the temperature of the aqueous medium is lowered to the polymerization temperature. The polymerization temperature may be set to a temperature of 50° C. or above, preferably 55°-80° C., particularly preferably 60°-75° C. While continuing the stirring, a substantially water-insoluble polymerization initiator is added to the system to effect polymerization. After the completion of the reaction, the resultant polymer particles are washed, recovered by an appropriate method such as filtration, decantation and/or contrifugation, and dried, thereby to obtain colored polymer particles (A) used in the present invention. In the suspension polymerization, 200-3000 wt. parts of water is ordinarily used as an aqueous dispersion medium with respect to 100 wt. parts of the total weight of the polymerizable monomer and the low-softening point compound.

As another method for forming the base particles (A), there can be used a method wherein material for toner are mixed under heating and the resultant mixture in a melted state is formed into fine particles. Examples of such method may include various known methods of forming a liquid into fine droplets. More specifically, there may be used a method using a single fluid nozzle using a pressure, a dual fluid nozzle using a high-pressure gas stream, or a disk atomizer using a rotating disk.

In order to prepare base particles (A) to be used for a heat-fixing system, the base particles (A) per se or the binder resin thereof may preferably have a softening point measured by the following method of 90°-150° C., more preferably 90°-140° C.

Flow Tester Model CFT-500 (available from Shimazu Seisakusho K.K.) is used. Powder having passed through a 60-mesh sieve is used as a sample and weighed as about 1.0-1.5 g. The sample is pressed under a pressure of 100 kg/cm$^2$ for 1 minute by using a tablet shaper.

The pressed sample is subjected to measurement by means of Flow Tester under the following conditions:

| | |
|---|---|
| RARE TEMP | 5.0 D/M (°C./min) |
| SET TEMP | 50.0 DEG (°C.) |
| MAX TEMP | 200.0 DEG |
| INTERVAL | 2.5 DEG |
| PREHEAT | 300.0 SEC |
| LOAD | 20.0 KGP (kg) |
| DIE (DIA) | 0.5 MM (mm) |
| DIE (LENG) | 1.0 MM |
| PLUNGER | 1.0 CM$^2$ (cm$^2$) |

From the above measurement, the softening temperature of the sample is defined as the temperature corresponding to ½ of the stroke difference (of the piston placed on the sample) of from the resultant flow-initiation temperature to the flow-termination temperature of the sample.

Next, the silica powder (B) or (C) is described.

After the silica powder (B) is fixed to the base particles (A), silica powder (C) is added to the resultant product and dispersed and/or mixed therewith so that the fluidity may be improved. In general, such a mixing operation can be conducted by using a device and conditions similar to those as described above with respect to the pretreatment prior to fixing.

The silica powder to be fixed to the surfaces of the base particles (A) may preferably have a particle size of 0.002-0.2 micron, preferably 0.005-0.2 micron. The amount of the silica powder may preferably be 0.05-5 wt. parts, more preferably 0.1-5 wt. parts, particularly preferably 0.1-3 wt. parts, further preferably 0.3-3 wt. parts with respect to 100 wt. parts of the base particles (A). Below 0.05 wt. parts, the fixing of the silica powder only shows a little effect. The amount of above 5 wt. parts is disadvantageous to the fixability, and further provides an undesirable effect on the resultant image because the amount of particles not being fixed to the base particles (A) is increased.

In the above-mentioned fixing device, while the base particles (A) and silica powder (B) are caused to surely pass between the rotor or blade and the liner, the silica powder (B) is dispersed and fixed to the base particles (A) under the action of a considerable impact. When the thus fixed silica powder is observed with a field emission-type scanning electron microscope (magnification: 10,000), the silica powder is not substantially observed.

For comparison, we have conducted the following experiments.

Thus, the silica powder (B) was mixed with base particles (A) by means of a device as shown in FIG. 1, which had been used as a mixer in the prior art, at a rotating speed of the stirring vane of 40-50 m/sec and the mixing treatment was conducted by using the same period of time and temperature as those in the fixing device using impact means. Thereafter, silica powder (C) for improving fluidity was further added to the resultant mixture and subjected to image formation. As a result, the thus prepared developer provided much fog and was liable to deteriorate when left standing for a long period. Accordingly, good results were not obtained.

From the results of the above-mentioned comparative experiment, the application of the above-mentioned mechanical impact was considered important.

The silica powder (B) usable in the present invention may be silica fine powder produced by vapor phase oxidation of a silicon halide, or by a wet process. Further, there may also be used silica fine powder treated with a silicone oil, an amino-modified silicone oil, or/and a silane coupling agent.

The fine silica powder obtained by vapor phase oxidation of silicon halide used herein may be one called dry-process silica or fumed silica. Such fine silica powder may, for example, be obtained by pyrolytic oxidation of gaseous silicon tetrachloride in oxygen-hydrogen flame. The basic reaction scheme may be represented as follows:

$$SiCl_4+2H_2+O_2 \rightarrow SiO_2+4HCl$$

In the above preparation step, it is also possible to obtain complex fine powder of silica and other metal oxides by using other metal halides such as aluminum chloride or titanium chloride together with silicon halides. Such is also included in the silica fine powder to be used in the present invention.

Commercially available silica fine powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | TT 600 |
| | MOX 80 |
| | MOX 170 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |
| (Dow Corning Co.) | |
| Fransol | |
| (Fransil Co.) | |

On the other hand, in order to produce silica fine powder to be used in the present invention through the wet process, for example, decomposition of sodium silicate with an acid represented by the following scheme may be applied:

$$Na_2O{\cdot}xSiO_2+HCl+H_2O \rightarrow SiO_2{\cdot}nH_2O+NaCl.$$

In addition, there may also be used a process wherein sodium silicate is decomposed with an ammonium salt or an alkali salt, a process wherein an alkaline earth metal silicate is produced from sodium silicate and decomposed with an acid to form silicic acid, a process wherein a sodium silicate solution is treated with an ion-exchange resin to form silicic acid, and a process wherein natural silicic acid or silicate is utilized.

The silica fine power to be used herein may be anhydrous silicon dioxide (silica), and also a silicate such as aluminum silicate, sodium silicate, potassium silicate, magnesium silicate and zinc silicate.

In the present invention, these wet process silica fine powders may preferably be heat-treated at 400° C. or higher and may preferably be used in the present invention. In such a heat treatment, for example, the silica fine powder produced by the wet process is charged in an electric furnace and left therein at 400° C. or higher for 10 min. to 10 hours.

The developer according to the present invention containing the wet process silica fine powder which has been heat-treated at 400° C. or higher may provide a stable and uniform triboelectric charge amount between toner particles, between toner and carrier or between toner and a toner-carrying member such as sleeve in the case of the one-component developing method. Accordingly, such a developer may provide a large number of good copies in successive copying without causing fog, toner scattering or toner agglomeration, and may reproduce stable images without the effect of a change in temperature and humidity, and particularly, it provides a high transfer efficiency even at an extremely high humidity. Further, such a developer provides a very small decrease in triboelectric charge amount and provides substantially no decrease in the image quality of copied images even when stored under high temperature-high humidity conditions for a long period.

Commercially available silicic acid fine powders formed by the wet process include those sold under the trade names as shown below:

Nipsil (Nippon Silica K.K.)
Tokusil, Finesil (Tokuyama Soda K.K.)
Bitasil (Tagi Seihi K.K.)
Silton, Silnex (Mizusawa Kagaku K.K.)
Starsil (Kamishima Kagaku K.K.)
Himesil (Ehime Yakuhin K.K.)
Siloid (Fuji Devison Kagaku K.K.)
Hi-Sil (Pittsuburgh Plate Glass Co.)
Durosil, Ultrasil (Fulstoff-Gesellshaft Marquart)
Ultrasil (Fullstoff-Gaselleschaft Marquart)
Manosil (Hardman and Holden)
Hoesch (Chemische Fabrik Hoesch K-G)
Sil-Stone (Stoner Rubber Co.)
Nalco (Nalco Chem. Co.)
Quso (Philadilphia Quartz Co.)
Imsil (Illinois Minerals Co.)
Calcium Silikat (Chemische Fabrik Hoesch, K-G)
Calsil (Fullstoff-Gesellschaft Marquart)
Fortafil (Imperial Chemical Industries)
Microcal (Joseph Crosfield & Sons. Ltd.)
Manosil (Hardman and Holden)
Vulkasil (Farbenfabriken Bayer, A.G.)
Tufknit (Durham Chemicals, Ltd.)
Silmos (Shiraishi Kogyo K.K.)
Starlex (Kamishima Kagaku K.K.)
Furikosil (Tagi Seihi K.K.)

In the present invention, there may be used silica which has been treated with a silane coupling agent so that it may be imparted with a hydrophobicity. The silica fine powder used in the present invention may preferably have a hydrophobicity of 30–80 according to the methanol titration test.

The methanol titration test used herein may be conducted in the following manner.

Sample silica powder (0.2 g) is charged into 50 ml of water in a 250 ml-Erlenmeyer's flask. Methanol is added dropwise from a buret until the whole amount of the silica is wetted therewith. During this operation, the content in the flask is constantly stirred by means of a magnetic stirrer. The end point can be observed when the total amount of the silica powder is suspended in the liquid, and the hydrophobicity is represented by the percentage of the methanol in the liquid mixture of water and methanol based on the quantity of methanol added on reaching the end point.

In order to impart hydrophobicity to the silica, a known hydrophobicity-imparting method may be used. More specifically, silica fine powder may be treated chemically with an organosilicon compound such as silane coupling agent and silicone oil which is capable of reacting with the silica or being physically adsorbed thereinto. In a preferred embodiment, the silica fine powder produced by vapor phase oxidation of a silicon halide is treated with a silane coupling agent and thereafter it is treated with an organosilicon compound; or the above-mentioned silica is treated with an organosilicon compound simultaneously with the treatment with a silane coupling agent.

Examples of such an organosilicon compound include; hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylcholrosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinylmethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds. The above-mentioned treating agent may preferably be used in an amount of 0.1–100 wt. parts, more preferably 1–80 wt. parts per 100 wt. parts of the silica powder.

The silicone oil to be used for the above-mentioned silicone oil treatment may generally be one represented by the following formula:

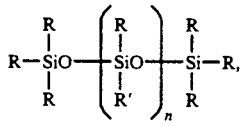

wherein R denotes an alkyl group, R′ denotes an alkyl or aromatic group capable of having a substituent, and n denotes an integer.

In the present invention, it is preferred to use a silicone oil having a viscosity of about 5–5,000 cs (centistoke), at 25° C. Preferred examples of the silicone oil may include: methylsilicone oil, dimethylsilicon oil, phenylmethhylsilicone oil, chlorophenylmethylsilicone oil, alkyl-modified silicone oil, fatty acid-modified silicone oil, and polyoxyalkylene-modified silicone oil. These silicone oils may be used singly or as a mixture of two or more species.

In a preferred embodiment, the silica fine powder produced by vapor phase oxidation of a silicon halide is treated with a silane coupling agent and thereafter it is treated with an organosilicon compound; or the above-mentioned silica is treated with an organosilicon compound simultaneously with the treatment with a silane coupling agent.

For example, the silica fine powder may be directly mixed with a silicone oil by means of a mixer such as Henschel mixer, or a silicone oil may be sprayed on the silica. Alternatively, the treated silica may be prepared by dissolving or dispersing a silicone oil in an appropriate solvent, mixing the resultant solution or dispersion with silica fine powder as a base, and then removing the solvent.

When the silica fine powder used in the present invention is treated with either one or both of the above-mentioned silane coupling agent and silicone oil, the developer containing such silica fine powder may stably provides a large triboelectric charge amount and a chargeability capable of providing a sharp and uniform triboelectric charge distribution. When both of the silane coupling agent and silicone oil are used, the weight ratio therebetween for the treatment of silica fine powder may preferably be 15:85 to 85:15. The triboelectric charge amount of the developer containing such silica fine powder may desirably be adjusted by changing the above-mentioned weight ratio. The total amount of the silane coupling agent and silicone oil may preferably be 0.1–30 wt. %, more preferably 0.5–20 wt. % based on the weight of the silica fine powder.

Since the amino-modified silicone oil to be used for the amino-modified silicone oil treatment is colorless or pale white, it may provide a color developer capable of providing very clear color tones, when such a silicone oil is used for a positively chargeable color developer. In the present invention, it is preferred to use an amino-modified silicone oil which is stable, has a heat resistance of about 300° C., and hardly causes degradation or deterioration due to heat or mechanical impact.

Since the amino-modified silicone oil preferably used in the present invention has a strong positive chargeability and an excellent stability to humidity, it has good positive chargeability even under a high-humidity condition, whereby clear images are provided.

Specific examples of such an amino-modified silicone oil include those under the trade names as shown below:

| Trade name | Viscosity at 25° C. (cps) | Amine equivalent |
|---|---|---|
| SF8417 (Toray Silicone K.K.) | 1200 | 3500 |
| KF393 (Shinetsu Kagaku K.K.) | 60 | 360 |
| KF857 (Shinetsu Kagaku K.K.) | 70 | 830 |
| KF859 (Shinetsu Kagaku K.K.) | 60 | 22500 |
| KF860 (Shinetsu Kagaku K.K.) | 250 | 7600 |
| KF861 (Shinetsu Kagaku K.K.) | 3500 | 2000 |
| KF862 (Shinetsu Kagaku K.K.) | 750 | 1900 |
| KF864 (Shinetsu Kagaku K.K.) | 1700 | 3800 |
| KF865 (Shinetsu Kagaku K.K.) | 90 | 4400 |
| KF369 (Shinetsu Kagaku K.K.) | 20 | 320 |
| KF383 (Shinetsu Kagaku K.K.) | 20 | 320 |
| X-22-3680 (Shinetsu Kagaku K.K.) | 90 | 8800 |
| X-22-380D (Shinetsu Kagaku K.K.) | 2300 | 3800 |
| X-22-3801C (Shinetsu Kagaku K.K.) | 3500 | 3800 |

-continued

| Trade name | Viscosity at 25° C. (cps) | Amine equivalent |
|---|---|---|
| X-22-3810B (Shinetsu Kagaku K.K.) | 1300 | 1700 |

In a case where hygroscopic silica powder is used, when a large amount of such silica powder is added to the toner, it can considerably affect the environmental characteristic of the toner. Accordingly, it is generally preferred to use silica powder treated with a hydrophobicity-imparting agent as the silica powder (B). The silica powder (B) may more preferably comprise silica treated with a silane coupling agent, a silicone oil, or an amino-modified silicone oil.

The silica powder (C) for imparting a fluidity can comprise the same species as that of the above-mentioned silica powder (B). The silica powder (B) and the silica powder (C) may comprise the same species, or different species from each other.

In the present invention, in the case of negatively chargeable colored resinous particles (A), it is preferred that negatively chargeable hydrophobic colloidal silica (B) is fixed to the surfaces of the colored resinous particles (A), and then the resultant negatively chargeable toner is further mixed with negatively chargeable hydrophobic colloidal silica (C), as described in Examples appearing hereinafter.

On the other hand, in the case of positively chargeable colored resinous particles (A), it is preferred that positively chargeable hydrophobic colloidal silica (B) is fixed to the surfaces of the colored resinous particles (A), and then the resultant positively chargeable toner is further mixed with positively chargeable hydrophobic colloidal silica (C).

In the present invention, since the silica powder (B) is embedded in the surface layer of the toner particles, the resultant toner shows a better fluidity than that in the conventional toner not containing silica powder embedded therein. Accordingly, in the present invention, good fluidity may be obtained by the addition of a relatively small amount of silica powder (C). When a large number of copies are obtained through image formation using such a developer, the fluidity is little decreased, and the permanent adhesion of the toner to a member rubbing against the toner such as carrier particles and another part of a developing device is reduced on the basis of the effect of the silica powder (B) fixed to the surfaces of the toner particles, whereby good images may be obtained stably. Such a developer may provide good images even after it has been left standing under a high-humidity condition for a long period.

In order to obtain the above-mentioned effect, the amount of the addition of the silica powder (C) may preferably be as small as possible. More specifically, good results may be obtained when the silica powder (C) is added to the toner in an amount of 0.01–3 wt. parts, more preferably 0.05–3 wt. parts, particularly preferably 0.1–1 wt. parts with respect to 100 wt. parts of the toner particles having on their surfaces silica powder fixed thereto. In view of the storage stability and developing characteristic of the developer, it is preferred that the amount of the silica powder (C) is smaller than that of the silica powder (B).

In the present invention, another substance may be added to the toner together with the silica powder (C) in order to improve the toner performance. Examples of such a substance may include particles having a abrading property (i.e., abrasive), or lubricating fine powder.

The particles having an abrading property may preferably be those having a Mohs hardness of 3 or higher which comprise one or more species selected from inorganic oxides, nitrides, carbides, and metal salts of sulfuric acid or carbonic acid. Specific examples thereof may include: metal oxides such as $SrTiO_3$, $CeO_2$, CrO, $Al_2O_3$ and MgO; nitrides such as $Si_3N_4$; carbides such as SiC; sulfonic acid salts or carbonic acid salts such as $CaSO_4$, $BaSO_4$ and $CaCO_3$.

Preferred examples may include those having a Mohs hardness of 5 or higher such as $SrTiO_3$, $CeO_2$ (e.g., powders comprising $CeO_2$ and a rare earth element such as Mirek, Mirek T (mfd. by Mitsui Kinzoku K.K.), ROX M-1), $Si_3N_4$ and SiC.

These substances may be surface-treated with a coupling agent such as silane coupling agent, titanium coupling agent, zircoaluminate coupling agent; a silicone oil; or another organic compound.

The lubricating (or lubricative) fine powder may preferably comprise particles comprising a fluorine-containing polymer such as teflon, polyvinylidene fluoride, and fluorinated carbon; and particles comprising a fatty acid metal salt such as zinc stearate. These lubricating fine powder may preferably have an average particle size of 6 microns or smaller, more preferably 5 microns or smaller.

When the particles having an abrading property and/or lubricating fine powder is added to the toner or developer according to the present invention, paper dust and fine toner particles disposed on a photosensitive member are prevented from forming a film, and better images may be provided more stably with the elapse of time. The particles having an abrading property can be fixed to the surfaces of toner particles together with the silica powder (B).

In the present invention, the amount of silica powder contained in the developer may be measured by means of an X-ray fluorescence analyzer (trade name: System 3080, mfd. by Rigaku Denki K.K.) and a data processor (trade name: Dataflex, mfd. by Rigaku Denki K.K.) converted to the analyzer.

More specifically, silica fine powder to be used is mixed with toner particles, with which silica powder has not been dry-mixed yet, by means of a coffee mill by external addition thereby to prepare sample developers respectively having silica powder contents of, e.g., 0.0, 0.5, 1.0, 1.5 wt. %, etc. based on the weight of the toner, which are used as samples for providing a calibration curve. Then, measurement conditions for Si are called by means of the above-mentioned Dataflex, and each of the above-mentioned samples for providing a calibration curve are formed into a pellet.

More specifically, a pressure of 2000 kg/cm$^2$ is applied to about 4 g of the sample for about 30 sec, thereby to prepare a pellet having a thickness of about 2 mm and a diameter of about 39 mm.

Each of the thus pelletized samples is loaded in the above-mentioned System 3080, and is subjected to measurement while controlling the measurement conditions so that the kV-meter indicates 40 kV (accelerating voltage) and the mA-meter indicates 70 mA. In the measurement, the sample is irradiated with X-rays and a count number is measured with respect to a peak height in the range of angle of 108±2 degrees. Based on the count numbers measured in such a manner, each count number (ordinate) is plotted against the corresponding wt. % of the silica powder contained in each sample for calibration (abscissa) with respect to the respective pelletized sample, thereby to obtain a calibration curve.

Separately, a developer wherein the silica powder content is to be measured is pelletized in the same manner as described above to prepare a Sample A. The Samples A is loaded in the System 3080 and the count number therefor is measured in the same manner as that in the measurement of the samples for calibration. Based on such a measurement, the above-mentioned silica powder content used in the present invention (total silica content) may be determined by using the thus measured count number and the above-mentioned calibration curve.

Further, the content of silica powder not being fixed to (or embedded in) in the toner particles may be measured in the following manner.

10 g of a sample developer is dispersed in about 500 ml of water containing 1–2 wt. % of a surfactant, and ultrasonic vibrations (40–50 KHz, 100–200 W) are applied to the resultant dispersion for 1–2 min., while the dispersion is stirred, whereby the silica powder not being embedded in the toner particles is separated from the toner particles. Thereafter, the toner particles are collected or recovered from the resultant dispersion, washed with distilled water and dried to obtain toner particles for measurement.

Then, the thus obtained toner particles are subjected to the above-mentioned measurement of silica content, whereby the amount of the silica powder embedded in the toner particles may be obtained. Further, the amount of the silica powder not being embedded in the toner particles may be calculated by subtracting the thus obtained embedded silica powder content from the above-mentioned total silica content in the developer.

Hereinbelow, the present invention is described in more detail with reference to Examples.

EXAMPLE 1

| | |
|---|---|
| Styrene-2-ethylhexyl acrylate-divinylbenzene copolymer (copolymerization weight ratio 80:20:1, weight-average molecular weight (Mw): about 300,000) | 90 wt. parts |
| Chromium complex of di-tertiary-butylsalicylic acid | 4 wt. parts |
| Polyethylene wax (Hi-Wax 200P, mfd. by Mitsui Sekiyu Kagaku) | 4 wt. parts |
| Magnetic iron oxide powder (specific surface area: 8 m$^2$/g) | 60 wt. parts |

A mixture having the above prescription was melt-kneaded at 150° C. for about 30 min. by means of a roll mill. The thus obtained kneaded product was cooled and then pulverized by means of a pulverizer into particles having a volume-average particle size of about 10 microns. Fine powder was removed from the pulverized product by means of a wind-force classifier (zigzag classifier mfd. by Alpine Co.) thereby to obtain negatively chargeable colored (magnetic) particles (A) having a volume-average particle size of about 11.0 microns.

Then, 0.5 wt. part of negatively chargeable hydrophobic colloidal silica (trade name: R-972, mfd. by Nihon Aerosil K.K., particle size: 10–30 mμ (millimicron) was added to 100 wt. parts of the thus classified base particles (A), and the silica was dispersed in the base particles (A) by means of the device as shown in FIG. 1 at a peripheral speed of (the tip of) the stirring vane of 30 m/sec for 5 min., thereby to effect a pretreatment.

Thereafter, the resultant mixture was further treated by means of the device shown in FIG. 2A at a minimum clearance of about 3 mm, at a peripheral speed of the blade of 80 m/sec for 3 min., thereby to prepare a negatively chargeable magnetic toner comprising the base particles (A) and the negatively chargeable hydrophobic colloidal silica embedded in the surfaces of the base particles (A).

When the thus obtained toner was observed with an electron microscope (magnification: 10,000), it was found that no silica particles were present on the surfaces of the treated base particles (A) and substantially all the amount of the colloidal silica added was embedded in the surfaces of the base particles (A).

Then, 0.2 wt. parts of hydrophobic colloidal silica (R-972, mfd. by Nihon Aerosil K.K.) as powder (C) was externally added to 100 wt. parts of the toner comprising the base particles (A) and the above-mentioned hydrophobic colloidal silica embedded in to the surfaces of the base particles (A), and mixed therewith by means of the device shown in FIG. 1 at the peripheral speed of the stirring vane of 40 m/sec for 3 min., thereby to obtain a powder mixture, as a developer. When the thus obtained developer was observed with an electron microscope (magnification: 10,000), it was found that the hydrophobic colloidal silica particles (C) were attached to the surfaces of the toner particles.

The thus prepared developer was charged in the developing device of a copying machine (NP-270 RE, mfd. by Canon K.K.) and image formation including development was conducted. As a result, there were provided good images having an image density of 1.32 and showing good fixability and good anti-offset property without causing fog or toner scattering around the copied letters.

Further, after the developer was left standing under a high-humidity condition (35° C., 90% RH) for two weeks, the developer was subjected to image formation in the same manner as described above. As a result, there was substantially no increase in fog in the resultant image.

EXAMPLE 2

| | |
|---|---|
| Styrene-2-ethylhexyl acrylate-divinylbenzene copolymer (copolymerization weight ratio 80:20:1, weight-average molecular weight Mw: about 300,000) | 90 wt. parts |
| Nigrosine | 2 wt. parts |
| Polyethylene wax (Hi-Wax 200P, mfd. by Mitsui Sekiyu Kagaku) | 4 wt. parts |
| Magnetic iron oxide powder (specific surface area: 8 $m^2/g$) | 60 wt. parts |

A mixture having the above prescription was melt-kneaded at 150° C. for about 30 min. by means of a roll mill. The obtained kneaded product was cooled and then pulverized by means of a pulverizer into particles having a volume-average particle size of about 10 microns. Fine powder was removed from the pulverized product by means of a wind-force classifier (a zigzag classifier mfd. by Alpine Co.) thereby to obtain positively chargeable colored (magnetic) particles (A) having a volume-average particle size of about 11.0 microns.

Then, 0.3 wt. part of positively chargeable hydrophobic colloidal silica treated with amino-silicone oil (obtained by treating 100 wt. parts of dry-process colloidal silica (BET specific surface area=130 $m^2/g$) with 13 wt. parts of an amino-modified silicone oil) was added to 100 wt. parts of the thus classified base particles (A), and the silica was dispersed in the base particles (A) by means of the device show in FIG. 1 at a peripheral speed of the stirring vane of 30 m/sec for 5 min., thereby to effect a pretreatment.

Thereafter, the resultant mixture was further treated by means of the device shown in FIG. 2A, at a peripheral speed of the blade of 80 m/sec for 3 min., thereby to prepare a positively chargeable magnetic toner comprising the base particles (A) and the positively chargeable hydrophobic colloidal silica embedded in the surfaces of the base particles (A).

When the thus obtained toner was observed with an electron microscope, it was found that no colloidal silica particles were present on the surfaces of the treated base particles (A) and substantially all the amount of the colloidal silica added was embedded in the surfaces of the base particles (A).

Then, 0.2 wt. parts of positively chargeable hydrophobic colloidal silica (particle size: about 20 mμ, obtained by treating 100 wt. parts of dry-process colloidal silica (BET specific surface area=130 $m^2/g$) with 13 wt. parts of an amino-modified silicone oil) as powder (C) was externally added to 100 wt. parts of the toner comprising the base particles (A) and the above-mentioned hydrophobic colloidal silica embedded in the surfaces of the base particles (A), and mixed therewith by means of the device shown in FIG. 1 at a peripheral speed of the stirring vane of 40 m/sec for 3 min., thereby to obtain a powder mixture, as a developer. When the thus obtained developer was observed with an electron microscope, it was found that the hydrophobic colloidal silica particles (C) were attached to the surfaces of the toner particles.

The thus prepared developer was charged in the developing device of a copying machine (NP-3525, mfd. by Canon K.K.) and image formation including development was conducted. As a result, there were provided good images having an image density of 1.32 and showing good fixability and good anti-offset property without causing fog or toner scattering around the copied letters.

Further, after the developer was left standing under a high-humidity condition (35° C., 90% RH) for two weeks, the developer was subjected to image formation. As a result, there was substantially no increase in fog in the resultant image.

EXAMPLE 3

| | |
|---|---|
| Styrene-2-ethylhexyl acrylate-divinylbenzene copolymer (copolymerization weight ratio 80:20:1, weight-average molecular weight Mw: about 300,000) | 90 wt. parts |
| Chromium complex of di-tertiary-butylsalicylic acid | 4 wt. parts |
| Polyethylene wax (Hi-Wax 200P, mfd. by Mitsui Sekiyu Kagaku) | 4 wt. parts |
| Carbon black (Stering R, mfd. by Cabot Co.) | 10 wt. parts |

A mixture having the above prescription was melt-kneaded at 150° C. for about 30 min. by means of a roll mill. The obtained kneaded product was cooled and then pulverized by means of a pulverizer into particles having a volume-average particle size of about 10 microns. Fine powder was removed from the pulverized product by means of a wind-force classifier (a zigzag classifier mfd. by Alpine Co.) thereby to obtain negatively chargeable colored (magnetic) particles (A) having a volume-average particle size of about 11.0 microns.

Then, 0.3 wt. part of negatively chargeable hydrophobic colloidal silica (trade name: R-972, mfd. by Nihon Aerosil K.K.) was added to 100 wt. parts of the thus classified base particles (A), and the silica was dispersed in the base particles (A) by means of the device show in FIG. 1 at a peripheral speed of the stirring vane of 30 m/sec for 5 min., thereby to effect a pretreatment.

Thereafter, the resultant mixture was further treated by means of the device shown in FIG. 2A at a peripheral speed of the blade of 80 m/sec for 3 min., thereby to prepare a negatively chargeable non-magnetic toner comprising the base particles (A) and the negatively chargeable hydrophobic colloidal silica embedded in the surfaces of the base particles (A).

When the thus obtained toner was observed with an electron microscope, it was found that no silica particles were present on the surfaces of the treated base particles (A) and substantially all the amount of the colloidal silica added was embedded in the surfaces of the base particles (A).

Then, 0.2 wt. parts of hydrophobic colloidal silica (R-972, mfd. by Nihon Aerosil K.K.) as powder (C) was externally added to 100 wt. parts of the toner comprising the base particles (A) and the above-mentioned hydrophobic colloidal silica fixed to the surfaces of the base particles (A), and mixed therewith by means of the device shown in FIG. 1 at a peripheral speed of the stirring vane of 40 m/sec for 3 min., thereby to obtain a powder mixture, as a developer. When the thus obtained developer was observed with an electron microscope, it was found that the hydrophobic colloidal silica particles (C) were attached to the surfaces of the toner particles.

Separately, the surfaces of 100 wt. parts of ferrite particles having a particle size of 250–300 mesh were covered with 0.8 wt. part of a silicone resin thereby to prepare magnetic particles. 10 wt. parts of the above-mentioned developer was mixed with 100 wt. parts of the thus prepared magnetic particle to prepare a two-component developer.

Figure 5:
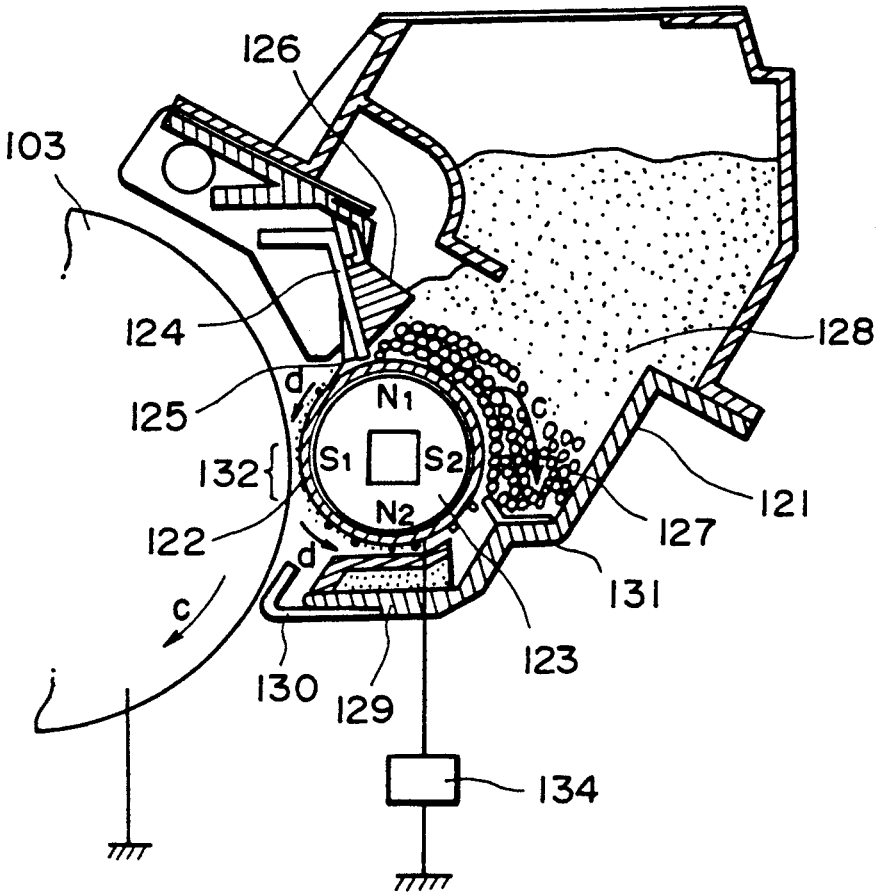
FIG. 5 is a schematic sectional view showing an image-forming device for effecting image formation by using the toner according to the present invention.

The thus prepared two-component developer was charged in the developing device as shown in FIG. 5 subjected to development, and the resultant toner image was transferred to plain paper, which was then fixed thereto by means of a heat and pressure fixing device. As a result, there were provided good images having an image density of 1.34 and showing good fixability and good anti-offset property without causing fog or toner scattering around the copied letters.

Figure 6:
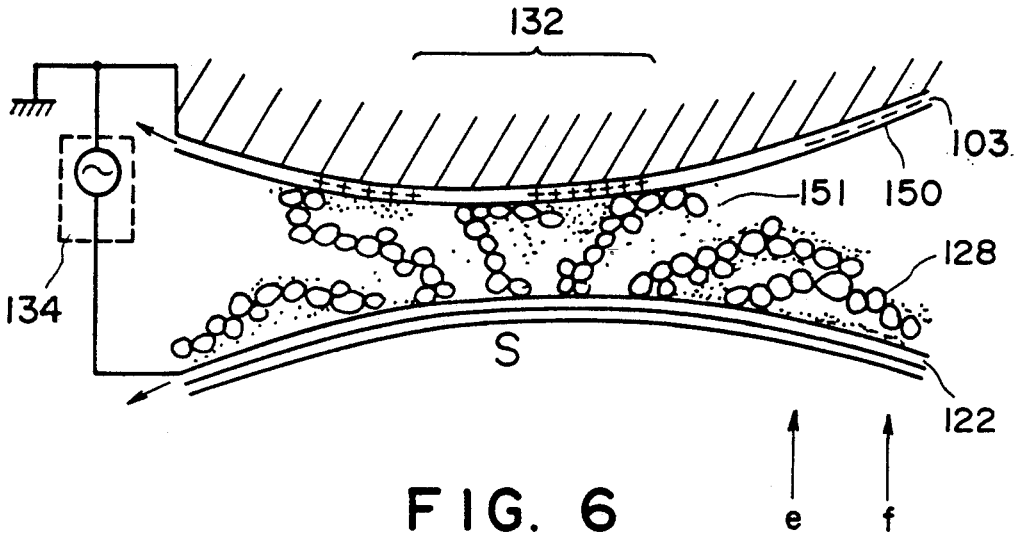
FIGS. 6 and 7 are enlarged schematic sectional views each showing a developing zone in the image-forming device shown in FIG. 5.
Figure 7:
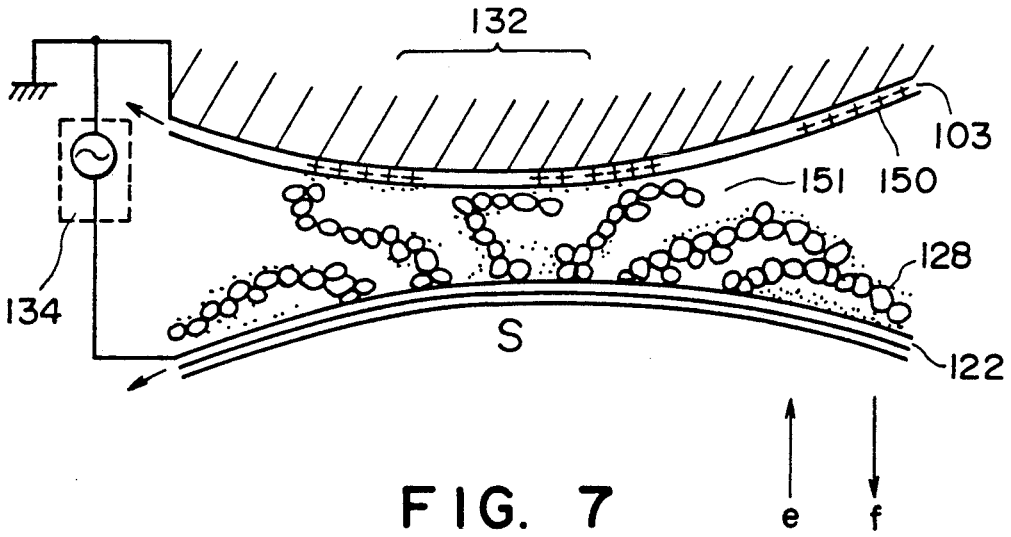

The developing apparatus shown in FIG. 5 comprises a photosensitive drum 103, a developer container 131, a non-magnetic sleeve 122, a fixed magnet 123, a non-magnetic blade 124, a member 126 for limiting a circulation region for magnetic particles, a container portion 129 for collecting a developer, a member 130 for preventing a scattering, a magnetic member 131 and a bias power supply 134. In FIG. 5, a reference numeral 127 denotes magnetic particles (carrier), numeral 128 denotes a non-magnetic toner, and numeral 132 denotes a developing zone. Further, FIG. 6 and FIG. 7 are enlarged views of the developing zone of the apparatus shown in FIG. 5. In FIGS. 6 and 7, an arrow e denotes the direction of the electric field based on a DC bias component, and an arrow f denotes that based on an AC bias component.

Referring to FIG. 5, in this instance, a photosensitive drum 103 rotated in the direction of an arrow a at a peripheral speed of 60 mm/sec, and a sleeve 122 comprised a hollow cylinder of stainless steel (SUS 304) having an outside diameter of 32 mm and a thickness of 0.8 mm, and rotated in the direction of an arrow b at a peripheral speed of 66 mm/sec. The surface of the sleeve had been subjected to a irregular-shape sandblasting by using an Alundum abrasive (#600).

On the other hand, a fixed magnet 123 of a ferrite-sinter type having poles of $N_1$, $N_2$, $S_1$ and $S_2$ was disposed in the rotating sleeve 122. Thus, a maximum magnetic flux density of about 800 Gauss was exerted to the surface of the sleeve (developer-carrying member). A non-magnetic blade 124 comprised non-magnetic stainless steel and had a thickness of 1.2 mm. The blade 124 and the sleeve 122 were disposed at a gap of 400 microns. The sleeve 122 and the photosensitive drum 103 were disposed opposite to each other at a gap of 300 microns.

On the surface of the photosensitive drum 103, an electrostatic latent image 150 of a charge pattern comprising a dark part potential of +600 V and a light part potential of +150 V was formed. A bias voltage having a frequency of 800 Hz, a peak-to-peak value of 1.4 KV and a central value of +300 V was applied to the sleeve 122 by means of a power supply 134. Thus, as shown in FIGS. 6 and 7, the electrostatic image 150 formed on the photosensitive drum 103 was developed by using a magnetic brush 151.

COMPARATIVE EXAMPLES 1–3

Base particles (A) having a particle size of 11.0 microns were prepared in the same manner as in Example 1. The fixing treatment described in Example 1 was omitted, and colloidal silica R-972 as silica powder (C) was externally added to the base particles (A) in amounts of 0.2 wt. %, 0.5 wt. % and 0.7 wt. %, respectively. The resultant mixture was treated by means of the device shown in FIG. 1 at the peripheral speed of the stirring vane of 40 m/sec for 3 min., thereby to obtain three species of powder mixtures, as developers of Comparative Examples 1–3, respectively. When the thus obtained developers were observed with an electron microscope, it was found that in the developers of Comparative Examples 2 and 3, a larger amount of the hydrophobic colloidal silica particles (C) were attached to the surfaces of the toner particles, as compared with that in the developer of Comparative Example 1.

Each of the thus prepared developers was charged in the developing device of a copying machine (NP-270 RE, mfd. by Canon K.K.) and image formation was conducted.

The results are shown in the following Table.

| | Ex. 1 | Comp. Ex. 1 | Comp. Ex. 2 | Comp. Ex. 3 |
|---|---|---|---|---|
| Toner fluidity | ○ | Δ | ○ | ○ |
| Image density | | | | |
| Initial stage | 1.34 | 1.26 | 1.30 | 1.22 |
| In successive | 1.28 | 1.24 | 1.24 | 1.06 |

-continued

| | Ex. 1 | Comp. Ex. 1 | Comp. Ex. 2 | Comp. Ex. 3 |
|---|---|---|---|---|
| copying | | | | |
| Scattering around letters | ○ | ○Δ | ○Δ | Δ |
| Fog | ○ | ○ | ○ | ○Δ |
| Fog* (after two-week standing) | ○ | Δ | Δ | Δ to x |

*The fog in the image obtained by using a developer which had been left standing under high temperature-high humidity conditions two weeks.

In the above Table, the symbols have the following meanings.

Toner fluidity

○: excellent
Δ: somewhat good

Scattering around letters (observation with the naked eyes)
○: excellent
○Δ: good
Δ: somewhat bad Fog (observation with the naked eyes)

○: excellent
○Δ: good

Fog after two-week standing (observation with the naked eye)
○: excellent
Δ: somewhat good
x: not good

COMPARATIVE EXAMPLE 4

Figure 8:
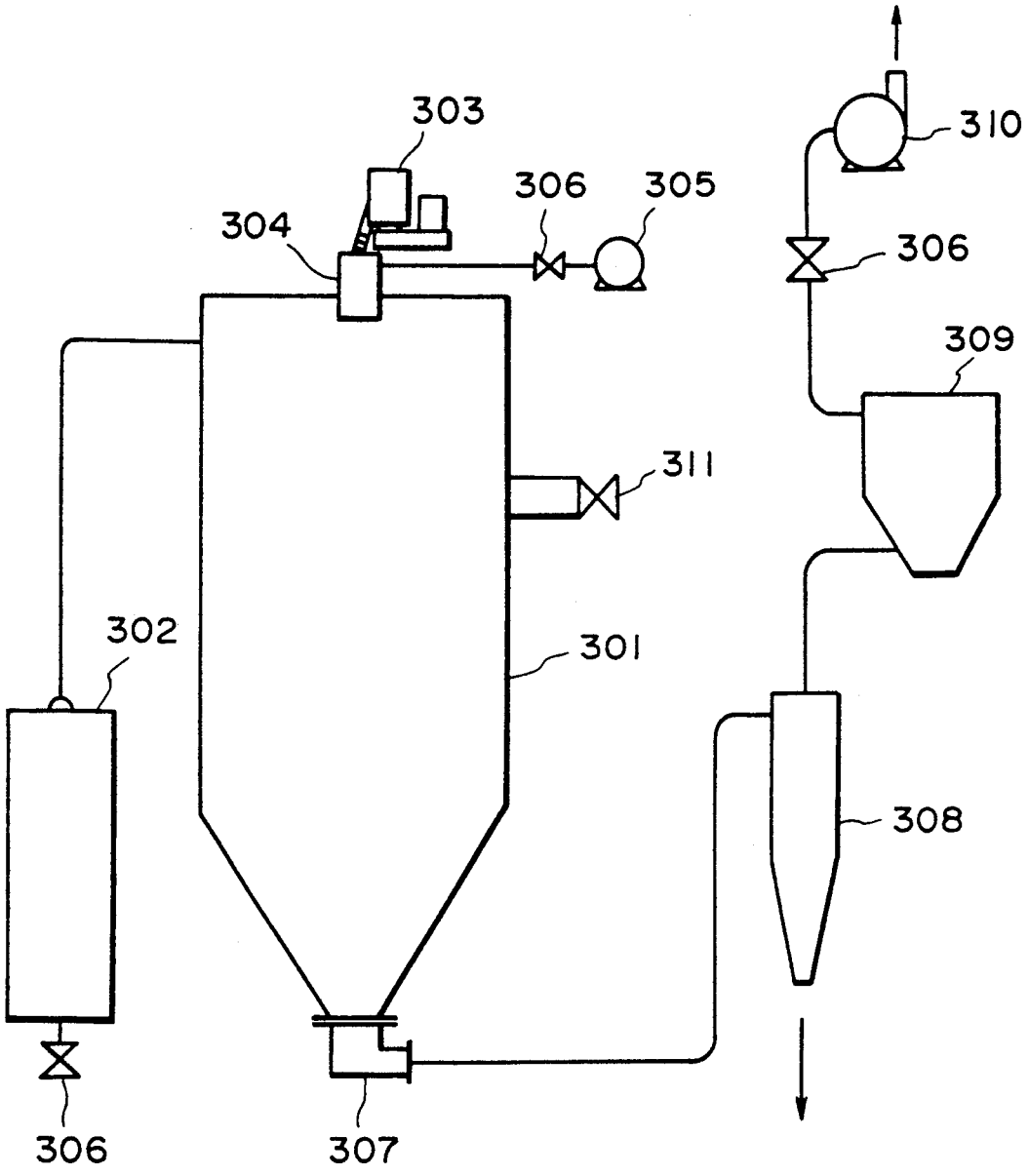
FIG. 8 is a schematic view illustrating an embodiment of a device for spheroiodizing particles by heating.

0.5 wt. % of hydrophobic colloidal silicic was fixed to the base particles (A) obtained in Example 1 by means of a device as shown in FIG. 8 using hot air of 200° C., and the resultant agglomerates were removed. Then, 0.2 wt. % of colloidal silica R-972 was added to the above-mentioned product and mixed therewith, thereby to prepare a developer.

Image formation was effected in the same manner as in Example 1 except for using the thus prepared developer. As a result, the image density was as low as 0.8, and fog due to cleaning failure was somewhat observed.

The device system for heat treatment used herein comprises: a heat-treating device 301, a hot blast stove 302, a material supply feeder 303, a material powder-dispersing pipe 304, a block 305 for air for dispersing the material, an air damper 306, a discharge port 307 of the heat-treating device, a cyclone 308 for collecting a treated product, a bug fillers 309, an exhaust blower 310, and a cold blast-intake part.

EXAMPLE 5

Hydrophobic colloidal silica was embedded in the base particles (A) in the same manner as in Example 1 to prepare a toner.

Then, 0.2 wt. part of hydrophobic colloidal silica (R-972, mfd. by Nihon Aerosil K.K.) and 1 wt. part of cerium oxide powder predominantly comprising $CeO_2$ were added to 100 wt. parts of the toner and mixed therewith by means of the device shown in FIG. 1 at a peripheral speed of the stirring vane of 40 m/sec for 3 min., thereby to obtain a developer.

The thus prepared developer was charged in the developing device of a copying machine (NP-270 RE, mfd. by Canon K.K.) and image formation including development was conducted. As a result, there were provided good images having an image density of 1.34 without causing fog or toner scattering around the copied letters.

Further, after the developer was left standing under a high-humidity condition (35° C., 90% RH) for two weeks, the developer was subjected to image formation. As a result, there was substantially no increase in fog in the resultant image, and the fixability and anti-offset property were good.

When the developer was subjected to successive copying of 5,000 sheets at 32.5° C. and 80% RH (humidity), a good image density of 1.28 (Macbeth densitometer) was obtained without causing fog.

EXAMPLE 6

Hydrophobic colloidal silica was embedded in the base particles (A) in the same manner as in Example 2 to prepare a toner.

Then, 0.2 wt. parts of hydrophobic colloidal silica treated with an amino-silicone oil (particle size: about 30 mμ) and 0.1 wt. part of polyvinylidene fluoride powder (volume-average particle size of about 3.7 microns) were added to 100 wt. parts of the toner and mixed therewith by means of the device shown in FIG. 1 at a peripheral speed of the stirring vane of 40 m/sec for 3 min., thereby to obtain a developer.

The thus prepared developer was charged in the developing device of a copying machine (NP-3525, mfd. by Canon K.K.) and image formation including development was conducted. As a result, there were provided good images having an image density of 1.33 without causing fog or toner scattering around the copied letters.

Further, after the developer was left standing under a high-humidity condition (35° C., 90% RH) for two weeks, the developer was subjected to image formation. As a result, there was substantially no increase in fog in the resultant image, and the fixability and anti-offset property were good.

When the developer was subjected to successive copying of 5,000 sheets at 32.5° C. and 80% RH (humidity), a good image density of 1.27 (Macbeth densitometer) was obtained without causing fog. Further, the cleaner was not damaged because of the lubricating effect of the above-mentioned lubricating material (polyvinylidene fluoride).

What is claimed is:

1. A developer for developing electrostatic images, comprising: 100 wt. parts of a toner comprising toner particles and 0.01–3 wt. parts of silica powder (C) which has a particle size of 0.005–0.2 micron and is not fixed to the surfaces of the toner particles;

said toner particles and said silica powder (C) having been dispersed and mixed with each other by means of a mixer having a stirring vane rotating at a peripheral speed at the tip of the stirring vane of 5–50 m/sec;

said toner particles comprising 100 wt. parts of colored resinous particles (A) and 0.05–5 wt. parts of silica powder (B) comprising silica particles which have a particle size of 0.002–0.2 micron and have been embedded in the surfaces of the colored resinous particles (A) by a mechanical impact means; and the amount of the silica powder (B) embedded in the surface of the colored resinous particles (A) is larger than the amount of the silica powder (C) not being fixed to the surfaces of the toner particles.

2. A developer according to claim 1, wherein the colored resinous particles (A) have a volume-average particle size of 2-20 microns.

3. A developer according to claim 1, wherein the colored resinous particles (A) comprise a binder resin and a colorant.

4. A developer according to claim 1, wherein the silica powder (B) and the colored resinous particles (A) have been dispersed and mixed with each other by means of a mixer having a stirring vane rotating at a peripheral speed at the tip of the stirring vane of 5-50 m/sec and then subjected to the impact means having an impacting member rotating at a peripheral speed at the tip of 30-100 m/sec to embed the silica powder (B) particles in the surfaces of the colored resinous particles (A) in a sufficiently dispersed state so that the silica powder (B) particles are not substantially observed through a field emission-type scanning electron microscope at a magnification of 10,000.

5. A developer according to claim 1, wherein the amount of the silica powder embedded in the surfaces of the colored resinous particles (A) is 0.1-5 wt. parts per 100 wt. parts of the colored resinous particles (A), and the amount of the silica powder not being fixed to the toner particles is 0.05-3 wt. parts per 100 wt. parts of the toner.

6. A developer according to claim 1, wherein the amount of the silica powder embedded in the surfaces of the colored resinous particles (A) is 0.3-3 wt. parts per 100 wt. parts of the colored resinous particles (A), and the amount of the silica powder not being fixed to the toner particles is 0.1-1 wt. parts per 100 wt. parts of the toner.

7. A developer according to claim 1, wherein the colored resinous particles (A) comprise a crosslinked styrene-type copolymer or a crosslinked polyester resin as a binder resin.

8. A developer according to claim 1, wherein the colored resinous particles (A) contain a negative charge controller; 0.05-5 wt. parts of negatively chargeable hydrophobic colloidal silica is embedded in 100 wt. parts of the colored resinous particles (A); 0.01-3 wt. parts of negatively chargeable hydrophobic colloidal silica not being fixed to the surfaces of the toner particles has been mixed with 100 wt. parts of the toner, and the amount of the negatively chargeable hydrophobic colloidal silica embedded in the surfaces of the colored resinous particles (A) is larger than that of the negatively chargeable hydrophobic colloidal silica not being fixed to surface of the the toner particles.

9. A developer according to claim 1, wherein the colored resinous particles (A) contain a positive charge controller; 0.05-5 wt. parts of positively chargeable hydrophobic colloidal silica is embedded in 100 wt. parts of the colored resinous particles (A); 0.01-3 wt. parts of positively chargeable hydrophobic colloidal silica not being fixed to the surfaces of the toner particles has been mixed with 100 wt. parts of the toner, and the amount of the positively chargeable hydrophobic colloidal silica embedded in the surfaces of the colored resinous particles (A) is larger than that of the positively chargeable hydrophobic colloidal silica not being fixed to the surfaces of the toner particles.

10. A developer according to claim 1, wherein the toner is a negatively chargeable magnetic toner which comprises: colored resinous particles (A) comprising a crosslinked styrene-type copolymer, a negative charge controller, a releasing agent and a magnetic material; and negatively chargeable hydrophobic colloidal silica embedded in the surfaces of colored resinous particles (A).

11. A developer according to claim 1, wherein the toner is a positively chargeable magnetic toner which comprises: colored resinous particles (A) comprising a crosslinked styrene-type copolymer, a positive charge controller, a releasing agent and a magnetic material; and positively chargeable hydrophobic colloidal silica which has been treated with an amino-modified silicone oil and is embedded in the surfaces of the colored resinous particles (A).

12. A developer according to claim 10, wherein the toner has been mixed with positively chargeable hydrophobic colloidal silica and fluorine-containing polymer powder.

13. A developer according to claim 1, wherein the silica powder (B) particles have been embedded in the surfaces of the colored resinous particles (A) by the mechanical impact means having an impacting member rotating at a peripheral speed at the tip of 30 to 130 m/sec in a sufficiently dispersed state so that the silica powder (B) particles are not substantially observed through a field emission-type scanning electron microscope at a magnification of 10,000.

14. A developer according to claim 1, wherein the silica powder (B) particles have been embedded in the surfaces of the colored resinous particles (A) by the mechanical impact means having an impacting member rotating at a peripheral speed at the tip of 30 to 100 m/sec in a sufficiently dispersed state so that the silica powder (B) particles are not substantially observed through a scanning electron microscope at a magnification of 10,000.

15. A developer according to claim 1, wherein the silica powder (B) and the colored resinous particles (A) have been dispersed and mixed with each other by means of a mixer having a stirring vane rotating at a peripheral speed at the tip of the stirring vane of 5-50 m/sec and then subjected to the impact means having an impacting member rotating at a peripheral speed at the tip of 30-130 m/sec to embed the silica powder (B) particles in the surfaces of the colored resinous particles (A) in a sufficiently dispersed state so that the silica powder (B) particles are not substantially observed through a field emission-type scanning electron microscope at a magnification of 10,000.

* * * * *

UNITED STATES PATENT AND TRADEMARK OFFICE

CERTIFICATE OF CORRECTION

PATENT NO. : 5,066,558

DATED : November 19, 1991

INVENTOR(S) : NORIO HIKAKE, ET AL.

It is certified that error appears in the above-identified patent and that said Letters Patent is hereby corrected as shown below: On the Title page :

IN [57] ABSTRACT

Line 4, "0.006-0.2" should read --0.005-0.2--.

COLUMN 4

Line 13, "spheroiodizing" should read --spheroidizing--.
Line 30, "embedded" should read --embedded in--.
Line 35, "comprises" should read --comprise--.
Line 49, "are" should read --is--.
Line 52, "Walls" should read --Waals--.

COLUMN 6

Line 4, "2°-100°" should read --20°-100°--.

COLUMN 7

Line 47, "1--3 min." should read --1-3 min.--.

COLUMN 8

Line 23, "base" should read --based--.

COLUMN 10

Line 6, "bees wax" should read --beeswax--.
Line 26, "the" should read --then the--.

COLUMN 11

Line 41, "or" should read --of--.
Line 61, "of" (1st occurrence)should read--or--.

UNITED STATES PATENT AND TRADEMARK OFFICE

CERTIFICATE OF CORRECTION

PATENT NO. : 5,066,558

DATED : November 19, 1991

INVENTOR(S) : NORIO HIKAKE, ET AL.

It is certified that error appears in the above-identified patent and that said Letters Patent is hereby corrected as shown below:

COLUMN 12

Line 28, "monomer" should read --monomer,--.
Line 33, "wt." should read --wt. %--.
Line 64, "material" should read --materials--.

COLUMN 13

Line 30, "of" should be deleted.

COLUMN 15

Line 46, "Pittsuburgh" should read --Pittsburgh--.
Line 47, "(Fulstoff-Gesellshaft" should read --(Fullstoff-Gesellschaft--.
Line 48, "Gaselleschaft" should read --Gesellschaft--.
Line 50, "Hoesch" should read --Hoechst-- (both occurrences).
Line 53, "Philadilphia" should read --Philadelphia--.
Line 55, "Hoesch," should read --Hoescht,--.

COLUMN 16

Lines 29-30, "include;" should read --include:--.
Line 33, "benzyldimethylcholrosilane," should read --benzyldimethylchlorosilane,--.
Line 66, "dimethylsilicon" should read --dimethylsilicone--.
Line 67, "phenylmethhylsilicone" should read --phenylmethylsilicone--.

COLUMN 17

Line 23, "provides" should read --provide--.

UNITED STATES PATENT AND TRADEMARK OFFICE

CERTIFICATE OF CORRECTION

PATENT NO. : 5,066,558

DATED : November 19, 1991

INVENTOR(S) : NORIO HIKAKE, ET AL.

It is certified that error appears in the above-identified patent and that said Letters Patent is hereby corrected as shown below:

COLUMN 18

Line 60, "parts" should read --part--.

COLUMN 19

Line 1, "a" should read --an--.
Line 25, "These" should read --This--.
Line 30, "is" should read --are--.

COLUMN 21

Line 18, "parts" should read --part--.
Line 22, "to" should be deleted.

COLUMN 22

Line 8, "show" should read --shown--.
Line 24, "parts" should read --part--.
Line 65, "(Stering" should read --(Sterling--.

COLUMN 23

Line 31, "parts" should read --part--.
Line 49, "particle" should read --particles--.

COLUMN 24

Line 9, "rotated" should read --is rotated--.
Line 13, "rotated" should read --is rotated--.
Line 15, "a" should read --an--.
Line 22, "comprised" should read --comprised of--.
Line 23, "and" (first occurrence) should be deleted.

UNITED STATES PATENT AND TRADEMARK OFFICE

CERTIFICATE OF CORRECTION

PATENT NO. : 5,066,558

DATED : November 19, 1991

INVENTOR(S) : NORIO HIKAKE, ET AL.

It is certified that error appears in the above-identified patent and that said Letters Patent is hereby corrected as shown below:

COLUMN 25

Line 20, "eyes)" should read --eye)--.
Line 25, "eyes)" should read --eye)--.
Line 53, "fillers" should read --filler--.

COLUMN 26

Line 21, "parts" should read --part--.

COLUMN 27

Line 36, "parts" (first occurrence) should read --part--.

Signed and Sealed this

Eighteenth Day of May, 1993

*Attest:*

*Attesting Officer*

Michael K. Kirk

MICHAEL K. KIRK

*Acting Commissioner of Patents and Trademarks*